US007055292B2

(12) United States Patent
Ailey et al.

(10) Patent No.: US 7,055,292 B2
(45) **Date of Patent: *Jun. 6, 2006**

(54) DEVICE FOR DEFINING A HANDLE IN A TUBULAR COVERING FOR A FOOD PRODUCT

(75) Inventors: Harrison A. Ailey, Knoxville, TN (US); Bradford L. Brewster, Oak Ridge, TN (US); Dennis J. May, Pittsboro, NC (US); Samuel D. Griggs, Raleigh, NC (US); Richard Scott Bruce, Knoxville, TN (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/229,925

(22) Filed: Sep. 19, 2005

(65) Prior Publication Data

US 2006/0010832 A1 Jan. 19, 2006

Related U.S. Application Data

(63) Continuation of application No. 10/782,552, filed on Feb. 19, 2004, now Pat. No. 6,945,010, which is a continuation of application No. 10/339,910, filed on Jan. 10, 2003, now Pat. No. 6,729,102.

(60) Provisional application No. 60/347,477, filed on Jan. 11, 2002.

(51) Int. Cl.
*B65B 9/20* (2006.01)
*B65B 61/14* (2006.01)
*B65B 3/28* (2006.01)

(52) U.S. Cl. ..... 53/134.1; 53/502; 53/551; 53/138.4

(58) Field of Classification Search ..... 53/134.1, 53/138.4, 413, 502, 551, 552; 29/243.57
See application file for complete search history.

(56) References Cited

U.S. PATENT DOCUMENTS 3,389,533 A * 6/1968 Tipper et al. ..... 53/134.1
4,165,593 A * 8/1979 Niedecker ..... 53/413
4,247,005 A * 1/1981 Buxton ..... 206/525
4,537,006 A * 8/1985 Pieri ..... 53/134.1
4,969,233 A * 11/1990 Stanley ..... 452/30

(Continued)

*Primary Examiner*—John Sipos
(74) *Attorney, Agent, or Firm*—Banner & Witcoff, Ltd.

(57) ABSTRACT

An apparatus for defining a loop handle in a tubular covering, such as an expanded mesh plastic covering, for a food. The apparatus of the present invention includes a frame for supporting the various assemblies that comprise the apparatus and for engaging a support surface such as a floor. The apparatus of the present invention further includes a conveyor assembly, which conveys the food product from a production line and into the slide area or chute. Positioned proximate the distal end of the chute is a voider assembly defined by a stationary set of voider gates and a movable set of voider gates. Further, the apparatus of the present invention includes a handle formation assembly for engaging the compressed cord of tubular covering and forming the compressed cord into a loop handle and a clipper device for engaging the handle formation assembly, and the engaged compressed cord of tubular covering and securing two clips to the cord, one to secure the bottom of the tubular covering for the previously processed food product, and one to secure the loop handle and for severing the compressed cord of tubular covering at a point disposed between the two securing clips.

11 Claims, 34 Drawing Sheets

U.S. PATENT DOCUMENTS 5,067,313 A * 11/1991 Evans ..... 53/576
5,109,648 A * 5/1992 Evans ..... 53/134.1
5,165,216 A * 11/1992 May et al. ..... 53/413
5,476,673 A * 12/1995 Sombrio ..... 426/410

* cited by examiner 90
84
100
102
99
92
93

90
94
102
100
84
92
93
98
99

90
94
102
100
84
92
93
98
99

90
94
93
84
100
102
92
98
99

90
93
84
100
102
92
98
99

DEVICE FOR DEFINING A HANDLE IN A TUBULAR COVERING FOR A FOOD PRODUCT

CROSS-REFERENCE TO RELATED APPLICATIONS

This application is a continuation of Non-provisional application Ser. No. 10/782,552, filed Feb. 19, 2004, now U.S. Pat. No. 6,945,010, which is a continuation of Non-Provisional application Ser. No. 10/339,910, filed Jan. 10, 2003, now U.S. Pat. No. 6,729,102, which claims the benefit of Provisional Application No. 60/347,477 filed Jan. 11, 2002.

BACKGROUND OF THE INVENTION

This invention pertains to a food packaging apparatus. More particularly, this invention pertains to a device for defining a loop handle in a tubular covering, such as an expandable mesh covering, for a food product, such as, but not limited to a meat product.

It is known in the food packaging industry to vacuum wrap consumer portions of food products, especially meat products. It is also known in the art to use expanded mesh coverings for food product during processing. To facilitate carrying, it has become customary to provide a tubular cover, such as an expanded plastic mesh cover for the vacuum wrapped food product. Further, this tubular mesh cover has a loop in one end in order to define a handle. Presently, formation of this loop handle is accomplished manually by hand. In this regard, a worker will bag the food product in the tubular expanded mesh covering, gather, or compress, an extended portion at one end, manually loop this extended portion back on itself and then clip the loop, with a conventional clipping apparatus, in order to secure the loop. Conventional clipping machines attach two clips, one to secure the bottom of the next covering to be formed and one to secure the loop handle. The conventional clipping machine then cuts the tubular covering between these two clips. Manual loop formation can limit the rate of production. What is needed is an apparatus for defining a handle in a tubular covering for a food product.

BRIEF SUMMARY OF THE INVENTION

The apparatus of the present invention is a device for covering a food product in a tubular covering, such as an expanded mesh plastic covering, which has a loop handle defined in one end of the tubular covering. As the food product proceeds through the apparatus, a handle is formed for the covering of the next food product and the open end of the tubular covering containing the food product is clipped, thereby securing the food product within the tubular covering. In the preferred embodiment, as the food product enters the apparatus, it is weighed so that a tag (containing certain information regarding the food product as will be known and appreciated by those skilled in the art) can be printed and secured in the loop handle defined in the portion of the tubular member that will receive the food product. While the apparatus described, and illustrated herein has been adapted specifically for bagging vacuum wrapped turkeys, either frozen or unfrozen, it will be appreciated by those skilled in the art that the apparatus can be adapted to define a loop handle in a tubular covering for other poultry products, other meat products and indeed other food products. Indeed, it will be appreciated by those skilled in the art that the device has utility in bundling non-food products as well.

The apparatus of the present invention includes a frame for supporting the various assemblies that comprise the apparatus and for engaging a support surface such as a floor. The frame also includes various guards and shields designed and intended to prevent an operator of the apparatus, or other individuals in close proximity to an operating apparatus, from being injured as a result of contact with moving components of the apparatus. Further, the various components of the apparatus of the present invention are preferably pneumatically driven and are controlled through a series of air valves, controlled by a programmable logic controller, PLC, as is conventionally known in the art. However, while operation of the apparatus by a PLC is preferred, it will be appreciated that the operations could be triggered selectively and sequentially by an operator toggling a series of switches. While selective operation of the apparatus would not be the preferred embodiment, such is certainly within the scope of the present disclosure.

The apparatus of the present invention includes a conveyor belt, preferably motor driven, which conveys the food product from a production line and into the slide area or chute. An initial conveyor stand and associated scale can be provided for weighing product prior to introducing the product into the slide area. While the conveyors are illustrated as being motor driven, those skilled in the art will recognize that other actuators, such as rotary actuators, could be utilized. It is anticipated that the conveyor would intersect a production line allowing a worker to remove a food product from the production line, weigh the product, if weight information is desired, and feed the food product onto the conveyor of the apparatus. The chute is a substantially tubular member which has the tubular covering expanded on the exterior of the chute, and positioned with respect to the distal end of the chute such that the food product will engage the tubular covering and thereby be covered by the tubular covering as the food product exits the chute. Positioned proximate the distal end of the chute is a voider assembly defined by a stationary set of voider gates and a movable set of voider gates. Each set of voider gates includes a top voider plate and a bottom voider plate, each voider plate having an opening that is adapted to be positioned so as to substantially register with the opening defined by the diameter of the chute. The stationary set of voider gates is proximate the distal end of the chute. When in the retracted position, the movable set of voider gates is proximate the stationary set voider gate. As will be explained in greater detail below, the openings in the top and bottom voider plates include cooperating bites that cooperate, and register, when the voider plates are closed so as to gather the tubular covering into a compressed cord.

Further, the apparatus of the present invention includes a handle formation assembly for engaging the compressed cord of tubular covering and forming the compressed cord into a loop handle. A clipper device, carried by the frame of the apparatus of the present invention rotates into a position to engage the handle formation assembly, and the engaged compressed cord of tubular covering and secures two clips to the cord, one to secure the bottom of the tubular covering for the previously processed food product, and one to secure the loop handle, (and tag), for the tubular covering in preparation of receiving a subsequent food product to be covered. Further a clipping knife severs the compressed cord of tubular covering at a point disposed between the two securing clips. A product restraining assembly is provided to capture and restrain the food product as it passes through the voider gate assembly, position the covered food product for clipping and to release the food product upon completion of the apparatus's handle formation and clipping cycle.

In an alternate embodiment, the device, absent the handle formation assembly, could be utilized for certain packing plant operations. In this regard, in certain packing plant operations, product is packaged in an expanded mesh covering. However, it is not necessary to form a loop handle in the package. Accordingly, for such operations, the handle formation assembly could either be deactivated or omitted.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figures 1, 1A:
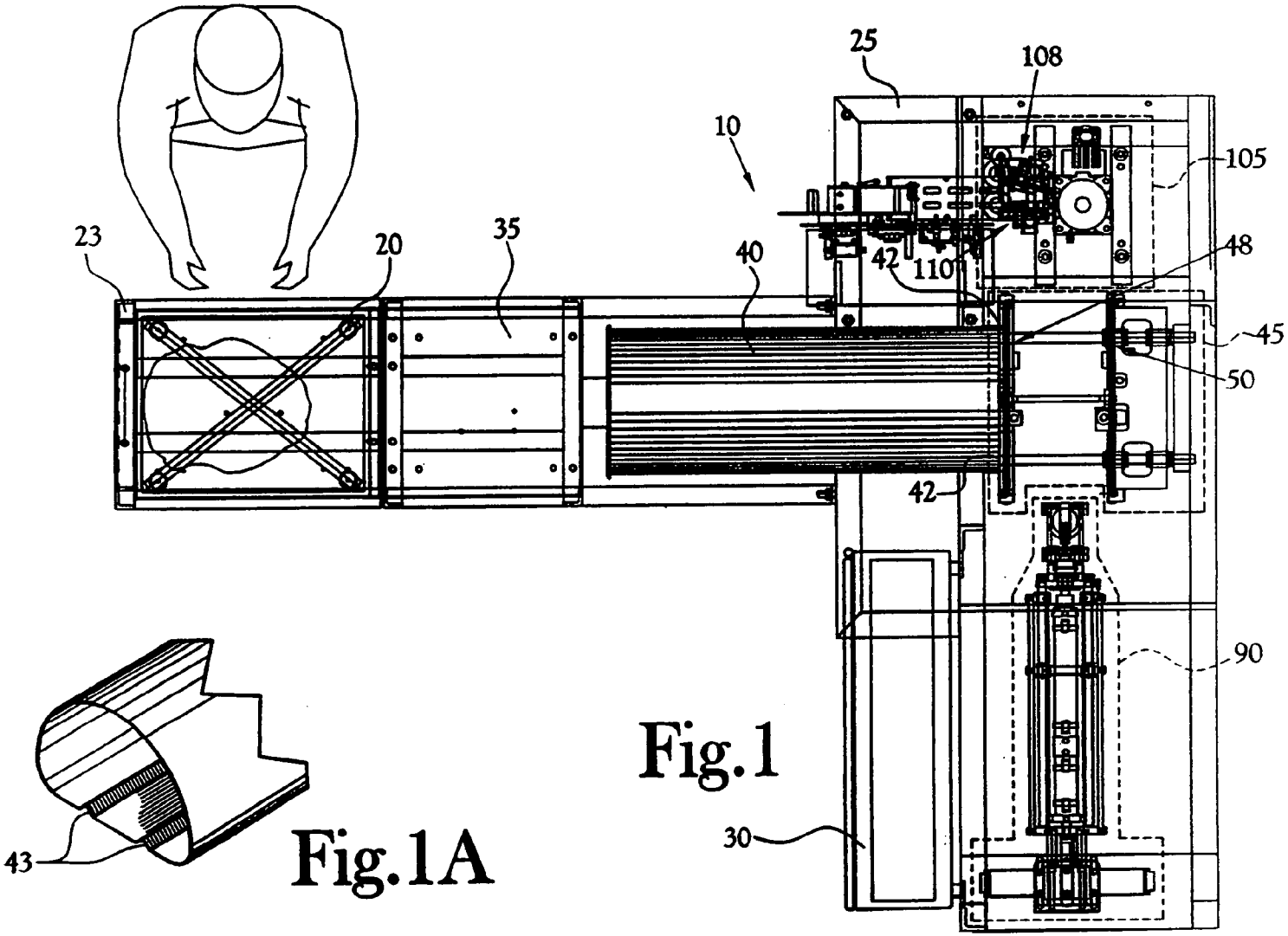
FIG. 1 is a plan view of the device of the present invention showing the movable voider in the extended position.
FIG. 1A is a partial perspective view of the chute which receives product and directs the product into the apparatus.

An apparatus for defining a loop handle in a tubular covering for a food product is disclosed. The apparatus, illustrated in the various figures, is designated as 10 in the figures. The apparatus 10 is a device for covering a food product in a tubular covering, such as an expanded mesh plastic covering, which has a loop handle 12 defined in one end of the tubular covering. Further, the apparatus 10 forms the loop handle 12 in the tubular covering 15. Those skilled in the art will recognize that, while the apparatus 10 is described and illustrated herein has being adapted specifically for bagging vacuum wrapped whole turkeys, it will be appreciated by those skilled in the art that the apparatus can be adapted to define a loop handle 12 in a tubular covering 15 for other poultry products, other meat products, other food products, and for non-food products.

Before an initial food product is introduced into the apparatus 10, the apparatus is operated for a cycle in order to form an initial handle loop. A complete product cycle is then defined by introduction of a product into the mesh covering, the open end, i.e., the end of the mesh covering opposite the handle loop, is secured and a loop handle is formed in the covering for the next food product. In other words, as the food product 16 proceeds through the apparatus 10, the food product 16 engages the mesh covering, the end of which is secured by a loop handle 12 which is formed in the covering, the apparatus 10 secures the open end of the tubular covering containing the food product 16, thereby securing the food product 16 within the tubular covering 15 and simultaneously forms a loop handle 12 for a subsequent food product. If desired, a food product 16 can be weighed prior to being processed by the apparatus 10. In this regard, the food product 16 is weighed on a scale 20, and if desired a tag (containing certain information regarding the food product as will be known and appreciated by those skilled in the art), dispensed by tag dispenser 22, can be printed and secured in the loop handle 12 defined in the portion of the tubular covering 15 that will receive the food product 16. While the scale 20 can be supported by the same framing as the balance of the apparatus 10, in the preferred embodiment, the scale 20 is supported by a discrete frame 23 so as to substantially isolate the scale from vibration caused by operation of apparatus 10. As stated above, it will be appreciated that this handle will be formed as the preceding food product travels through the apparatus.

The apparatus 10 of the present invention includes a frame 25 for supporting the various assemblies that comprise the apparatus 10 and for engaging a support surface such as a floor. The frame 25 also includes various guards and shields, (not shown for clarity of view), designed and intended to prevent an operator of the apparatus 10, or other individuals in close proximity to an operating apparatus, from being injured as a result of contact with moving components of the apparatus. These guards and shields would be readily known to those skilled in the art. Further, the various components of the apparatus 10 are, in the preferred embodiment, pneumatically driven and are controlled through a series of air valves, controlled by a programmable logic controller, PLC, (not shown), as is conventionally known in the art. A flow chart, illustrating the logic for one embodiment of the present invention is illustrated in FIGS. 19A through 19K. The PLC would be accessed via a console 30 in order to allow an operator to operate the apparatus 10. In this regard, in one embodiment, as can be seen by reviewing the flow chart in FIGS. 19A–19K, the operator can choose to operate the device in a continuous Run mode or in a Single Step mode. However, while operation of the apparatus 10 by the PLC is preferred, it will be appreciated that the operations could be triggered selectively, and sequentially by an operator toggling a series of switches.

Figure 9:
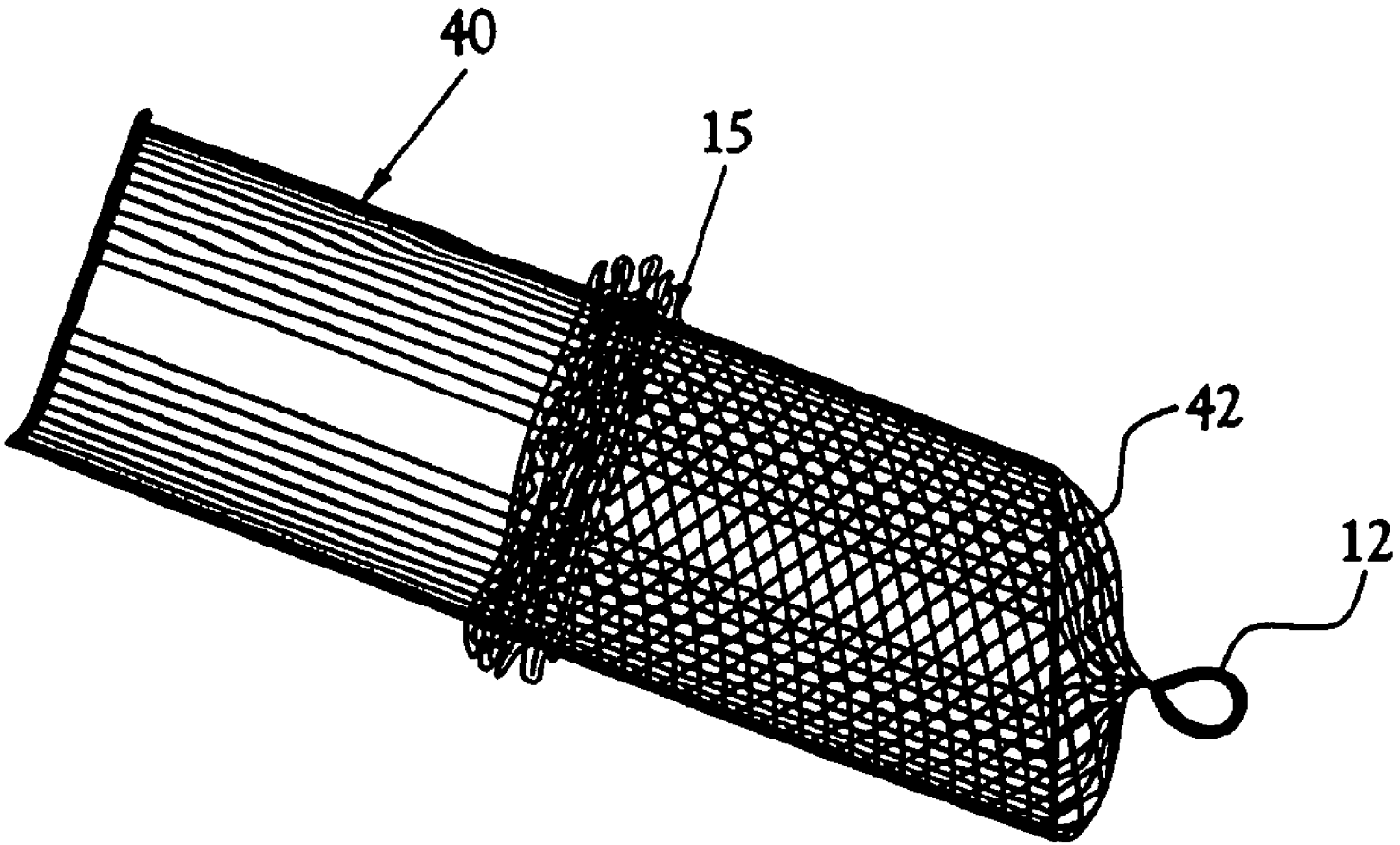
FIG. 9 is a side elevation view isolating the chute showing the expanded mesh covering in place on the chute.

The apparatus 10 includes a conveyor belt 35, preferably driven by a motor 38, which conveys the food product 16 from the scale 20, if weighing of the product is desired, and into the chute area or chute 40. In one embodiment of operation, the scale 20 and the conveyor belt 35 of the apparatus would intersect a production line (not shown) allowing a worker to remove the food product from the production line, and feed the food product onto the conveyor belt 35 of the apparatus 10. In the illustrated embodiment, the chute 40 is an elongated substantially tubular member. During operation of the apparatus 10, chute 40 would have the tubular covering 15 expanded on the exterior of the chute 40. Alternately, the chute could simply be defined by a slide having a skeletal frame for receiving the expanded tubular covering 15. The end of the tubular covering proximate the distal end 42 of the chute 40 is secured by the loop handle 12 which is positioned proximate the distal end 42 of the chute 40 such that the food product 16 will engage the tubular covering 15 and thereby be covered by the tubular covering 15 as the food product 16 exits the chute 40. This disposition of the bulk tubular covering 15 on the chute 40 is illustrated in FIG. 9. Chute 40 is preferably inclined such that the distal end 42 of the chute 40 is lower than conveyor belt 35 so as to allow the food product 16 to travel through the chute 40 by the force of gravity. In order to substantially prevent the food product 16 from rotating as it slides through chute 40, ridges 43 are disposed within the chute 40.

Figure 2:
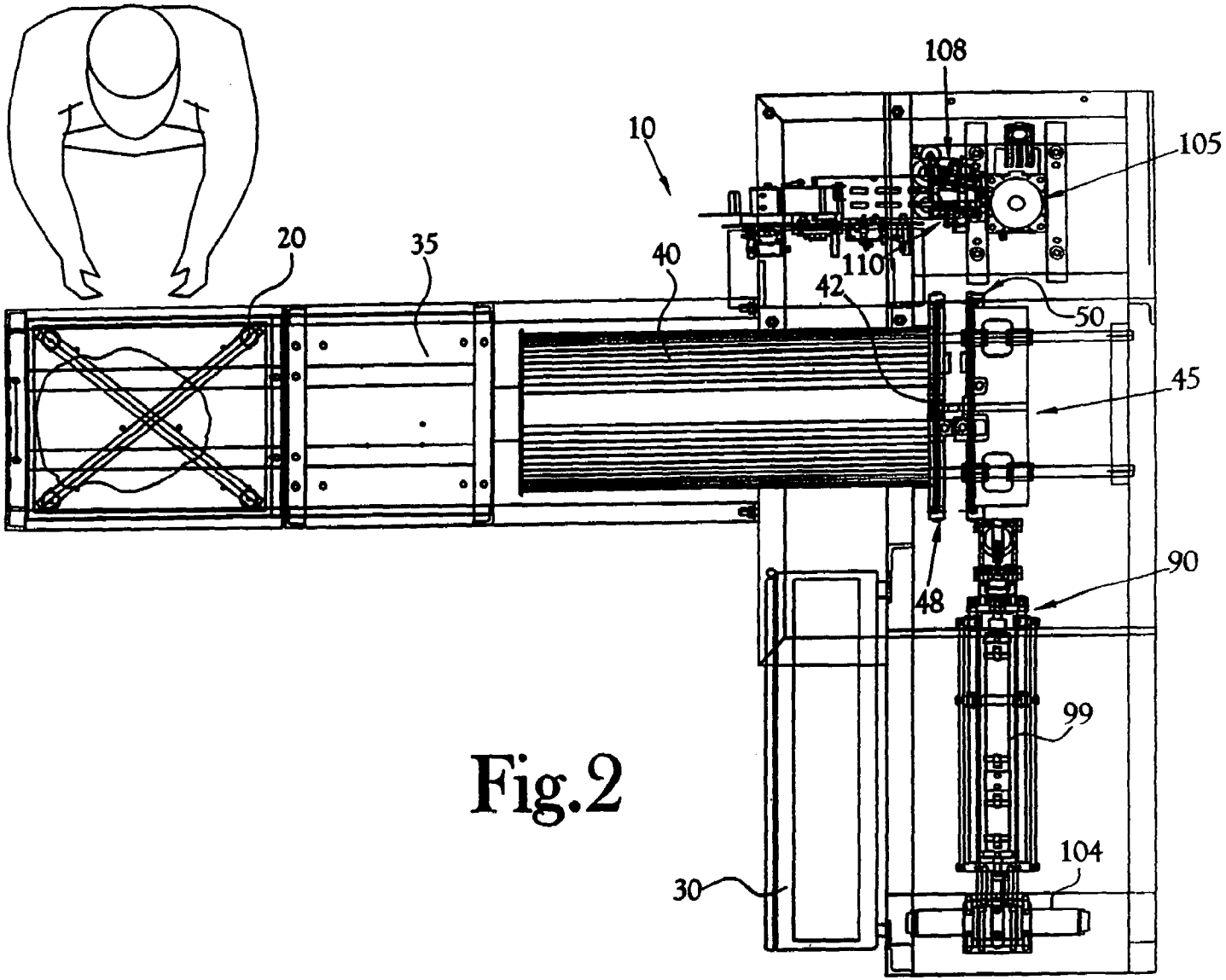
FIG. 2 is also a plan view of the device of the present invention showing the movable voider in the retracted position.
Figure 3:
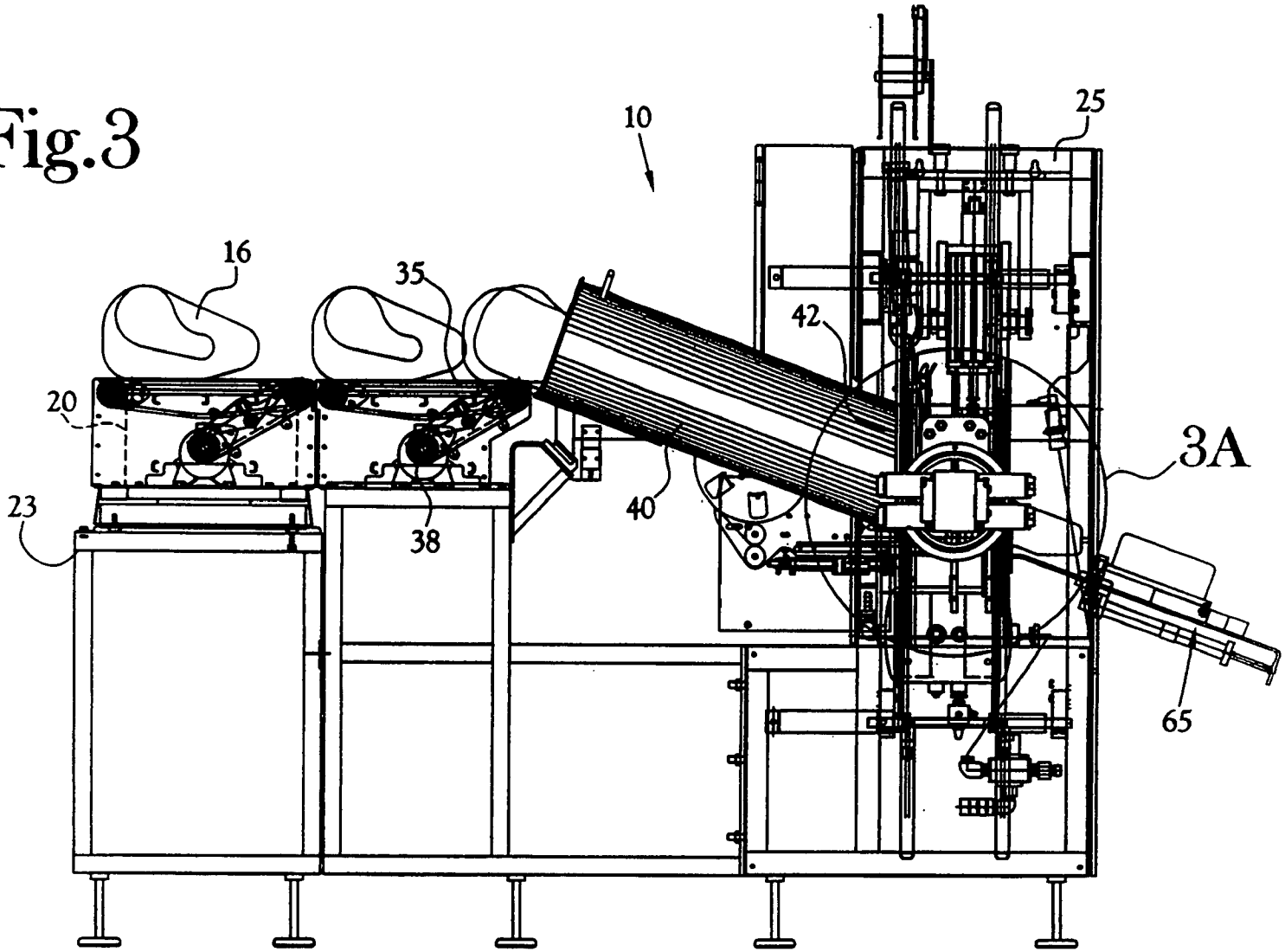
FIG. 3 is a side elevation view of the present device, with portions, such as safety shields and covers, removed for clarity of view.
Figure 3A:
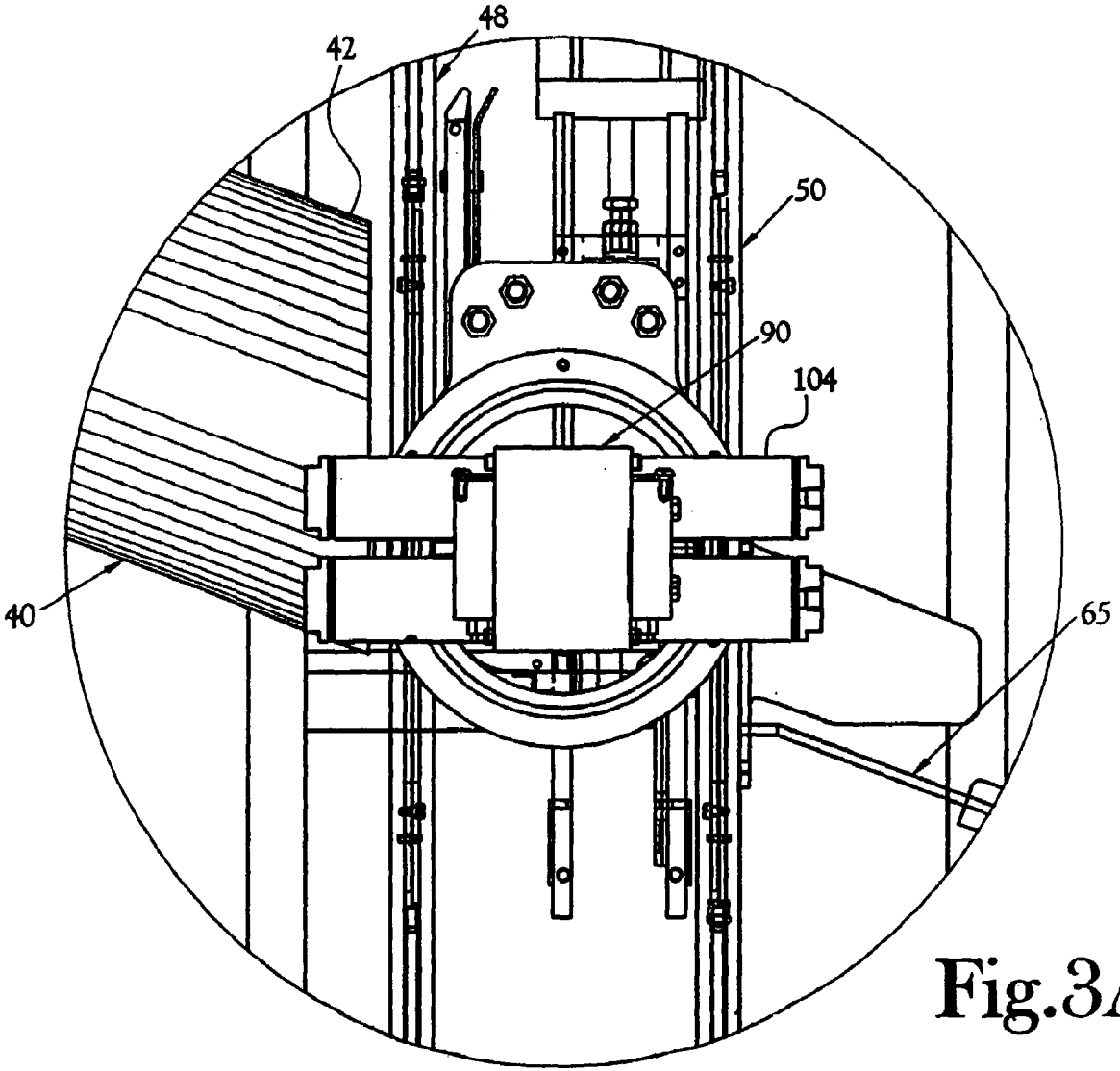
FIG. 3A is a detailed enlargement of the area within circle 3*a* in FIG. 3.
Figure 4:
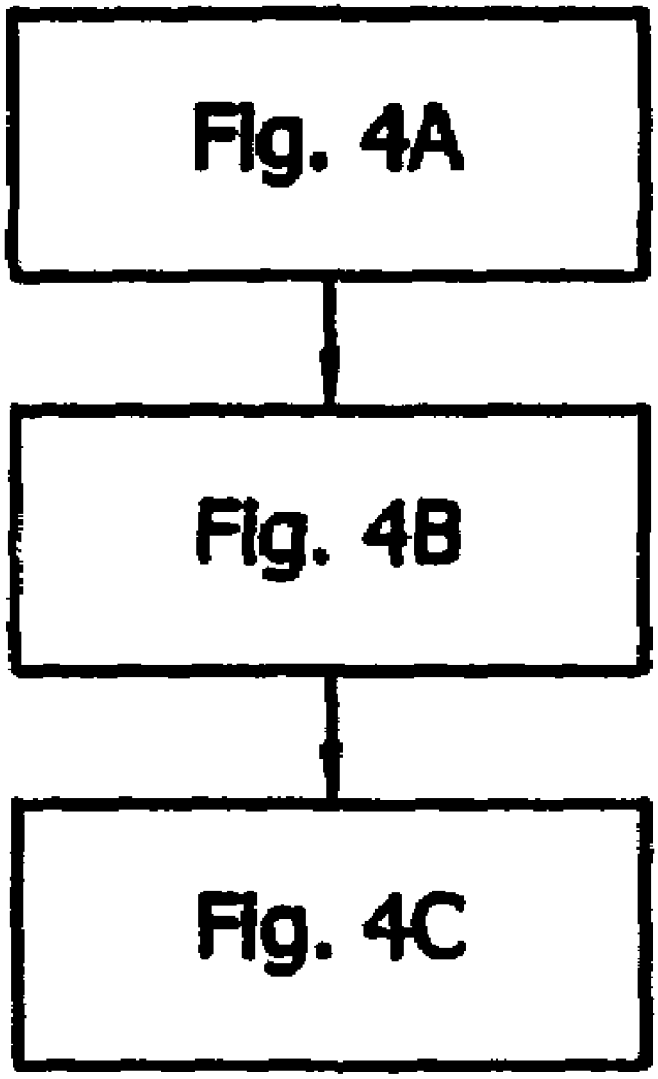
FIG. 4, inclusive of FIGS. 4A, 4B and 4C, is a flow diagram showing the operation of the device of the present invention.
Figure 4A:
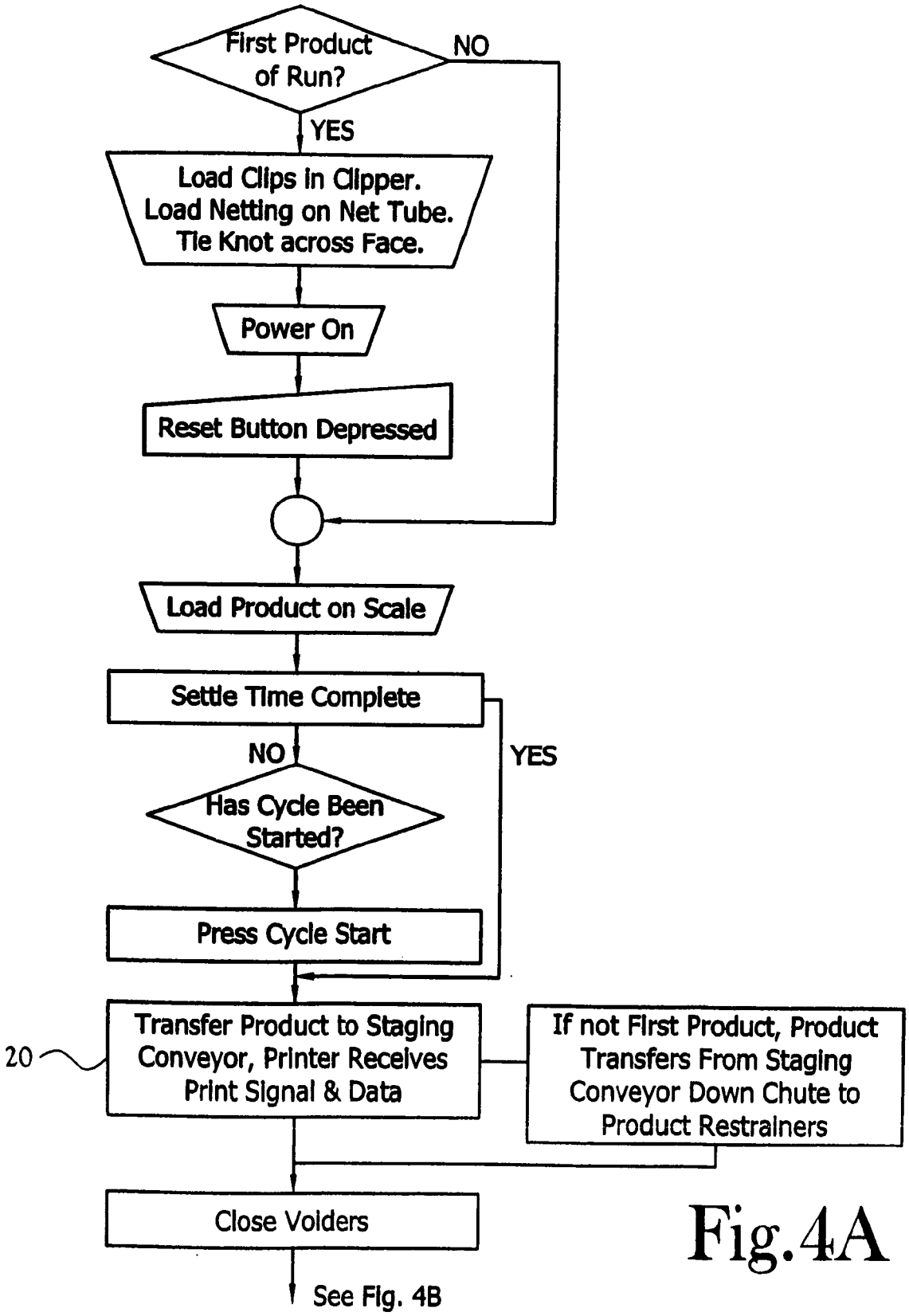
Figure 4B:
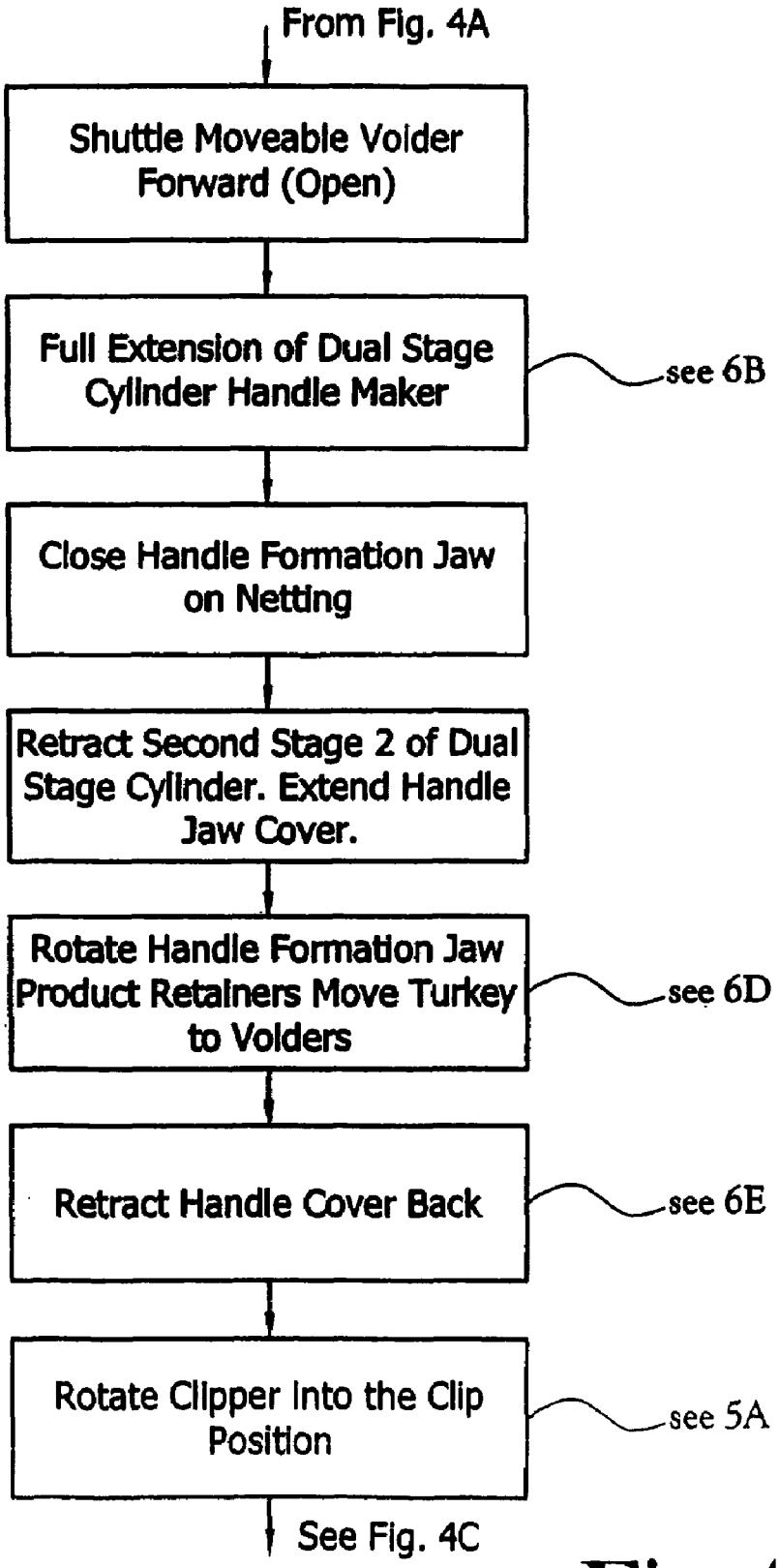
Figure 4C:
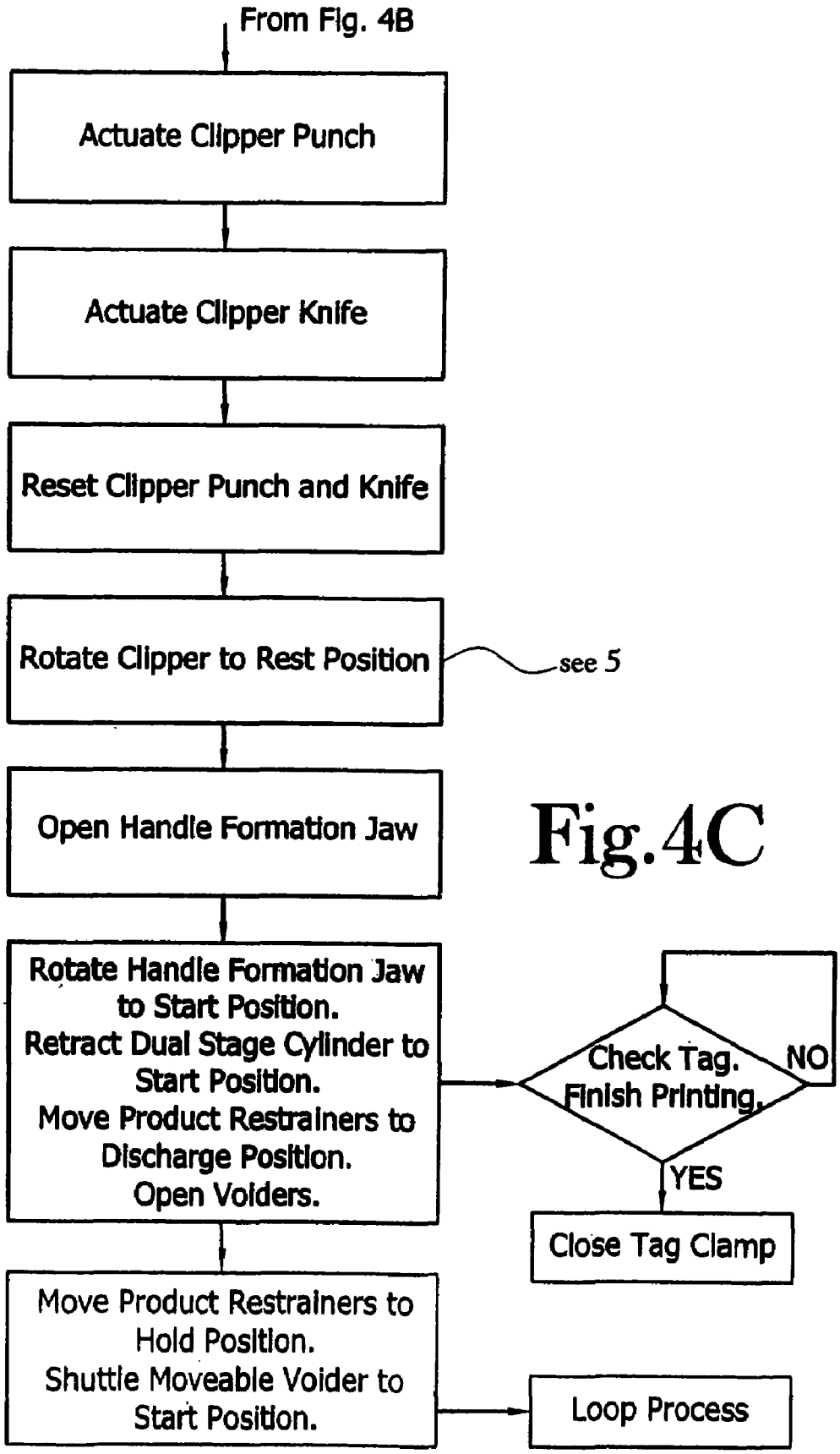

Positioned proximate the distal end 42 of the chute 40 is a voider assembly 45 defined by a stationary set of voider gates 48 and a movable set of voider gates 50. Each set of voider gates includes a top voider plate 54 and a bottom voider plate 56, each voider plate 54, 56 having an opening 58 and 60, respectively, that is adapted to be positioned so as to substantially register with the opening defined by the diameter of the chute 40. The stationary set of voider gate 48 is proximate the distal end 42 of the chute 40. When in the retracted position, illustrated in FIG. 2, the movable set of voider gates 50 is positioned proximate the stationary set of voider gates 48.

Figure 8A:
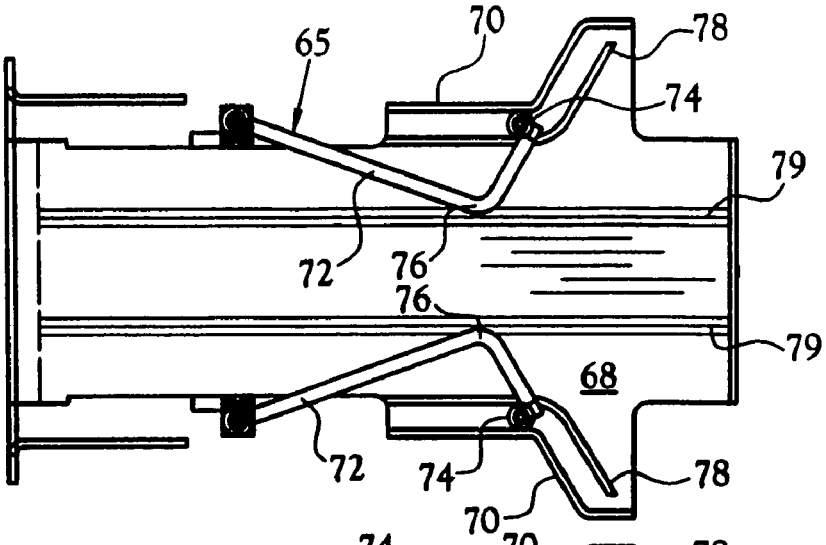
FIGS. 8A–8C are plan views of the product restrainer showing the three main positions of the product restrainer.
Figure 8B:
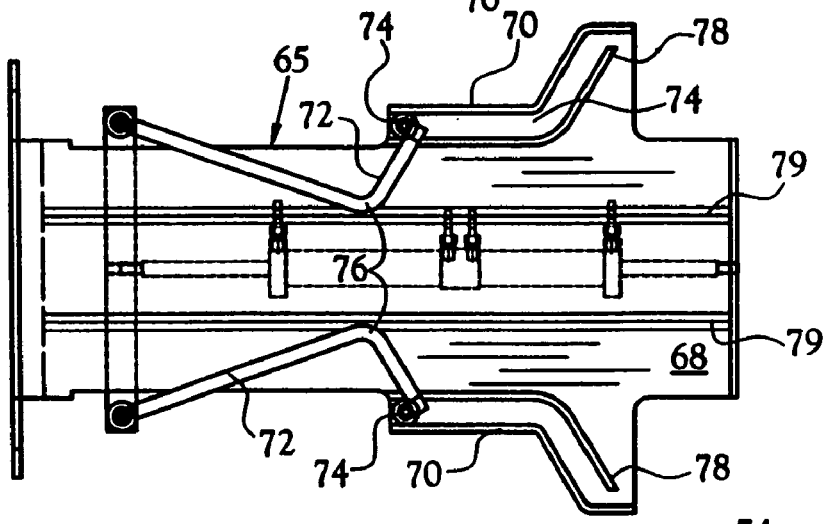
Figure 8C:
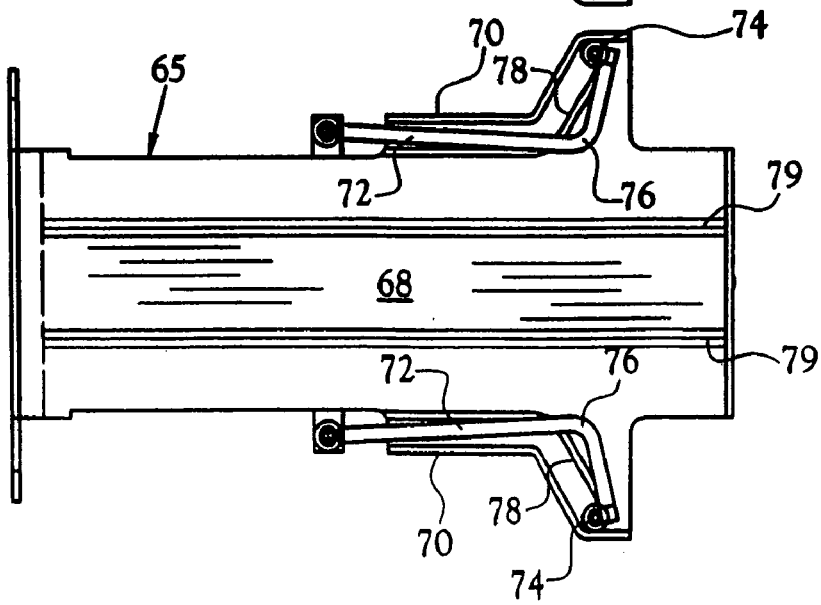

The apparatus 10 further comprises a food product restrainer assembly 65, illustrated in FIG. 8, carried by the movable set of voider gates 50, for receiving the food product 16 as the food product exits the chute 40 and passes through the voider gates 48 and 50. The food product restrainer assembly 65 includes a food product slide plate 68, guide plates 70 in spaced relation from one another and restrainer arms 72. Restrainer arms 72 have a bend 76 disposed along their length. Rollers 74 follow the contour of the guide plates 70 which are adapted so as to narrow the effective distance between the bends 76 disposed in restrainer arms 72 when the restrainer arms are positioned at their upper and uppermost positions, seen in FIGS. 8A, and 8B. This allows the restrainer arms 72 to catch the food product as it exits the chute 40. The guide plates 70 are further adapted to allow the effective distance between the restrainer arms 72 to increase at its lowermost position, seen in FIG. 8C in order to allow discharge of the covered food product. In order to prevent the restrainer arms 72 from rebounding inward during operation of the apparatus 10, the restrainer arms 72 are caged within rails 78 which are in substantially uniformly spaced relation from guide plates 70 and disposed on the product slide plate 68. Further, in order to substantially prevent the food product 16 from rotating while it is on the good product restrainer assembly 65, ridges 79, which are similar in nature and function to ridges 43 disposed within the chute 40, are provided on the product slide plate 68.

Figure 7A:
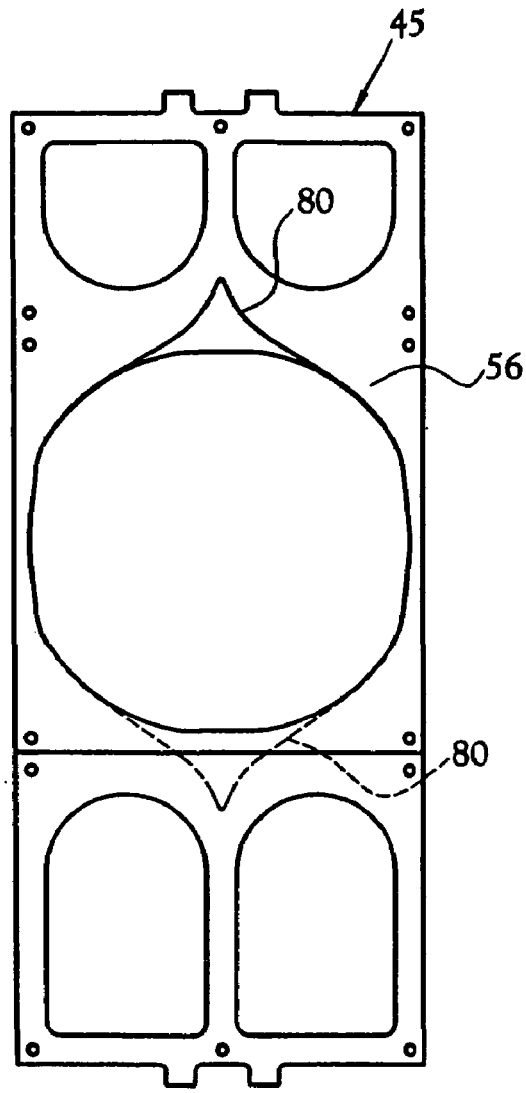
FIGS. 7A and 7B are elevation views of the voider gates in the open position in 7A and in the closed position in 7B.
Figure 7B:
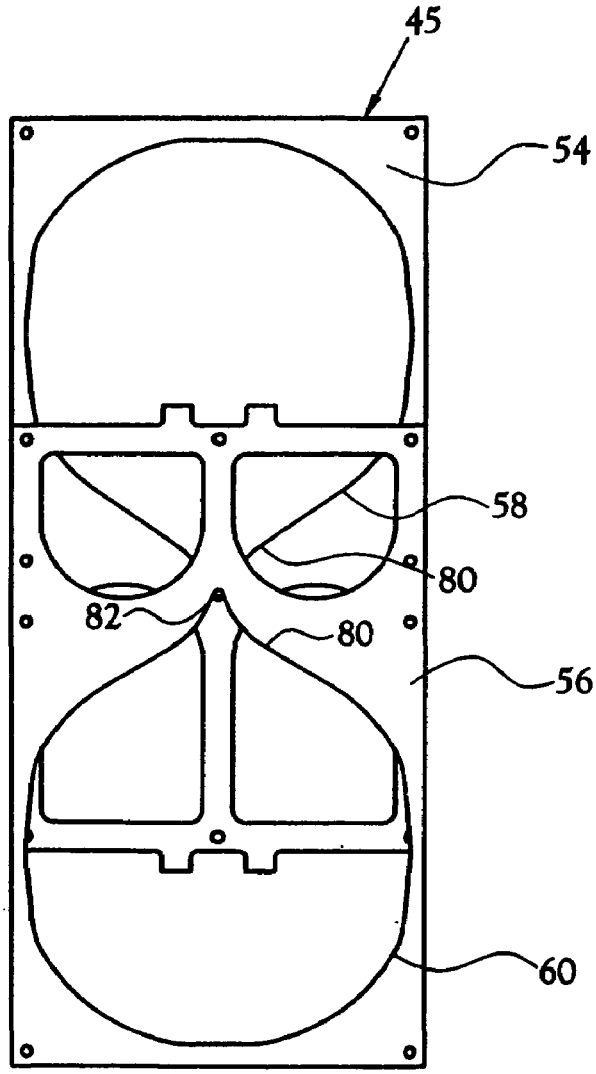

It will be appreciated by those skilled in the art that the tubular covering 15 is in an expanded configuration as the food product 16 exits the chute 40 and that the tubular covering 15 extends from the food product to the supply of tubular covering 15 disposed on the exterior of the chute 40. The apparatus 10 is adapted to compress this extended portion of the tubular member into a compressed cord in order to facilitate formation of the loop handle. In this regard, the openings 58 and 60 in the top and bottom voider plates include bites 80 that cooperate, and register, when the voider plates are closed, to form a narrow channel 82 that acts to gather the tubular covering 15 into a compressed cord 84. At the beginning of a cycle of operation, the movable voider gates 50 are in the retracted position, illustrated in FIG. 2, and the top and bottom voider plates 54 and 56 are in the open position such that food product 16 can pass through openings 58 and 60. After the food product 16 has passed through the voider gates, 48 and 50, the movable voider gate 50 is positioned to the extended position, seen in FIG. 1, and the top and bottom voider plates move to the closed position, illustrated in FIG. 7B, such that the bites 80 compress the tubular covering 15 into the compressed cord 84. In one embodiment, an air nozzle (not shown) is utilized to direct an air stream towards the loop handle 12 between cycles of operation, when the voider gates are recycled into the retracted position so as to prevent the loop handle 12 from being obstructed by the voider plates.

Figure 5:
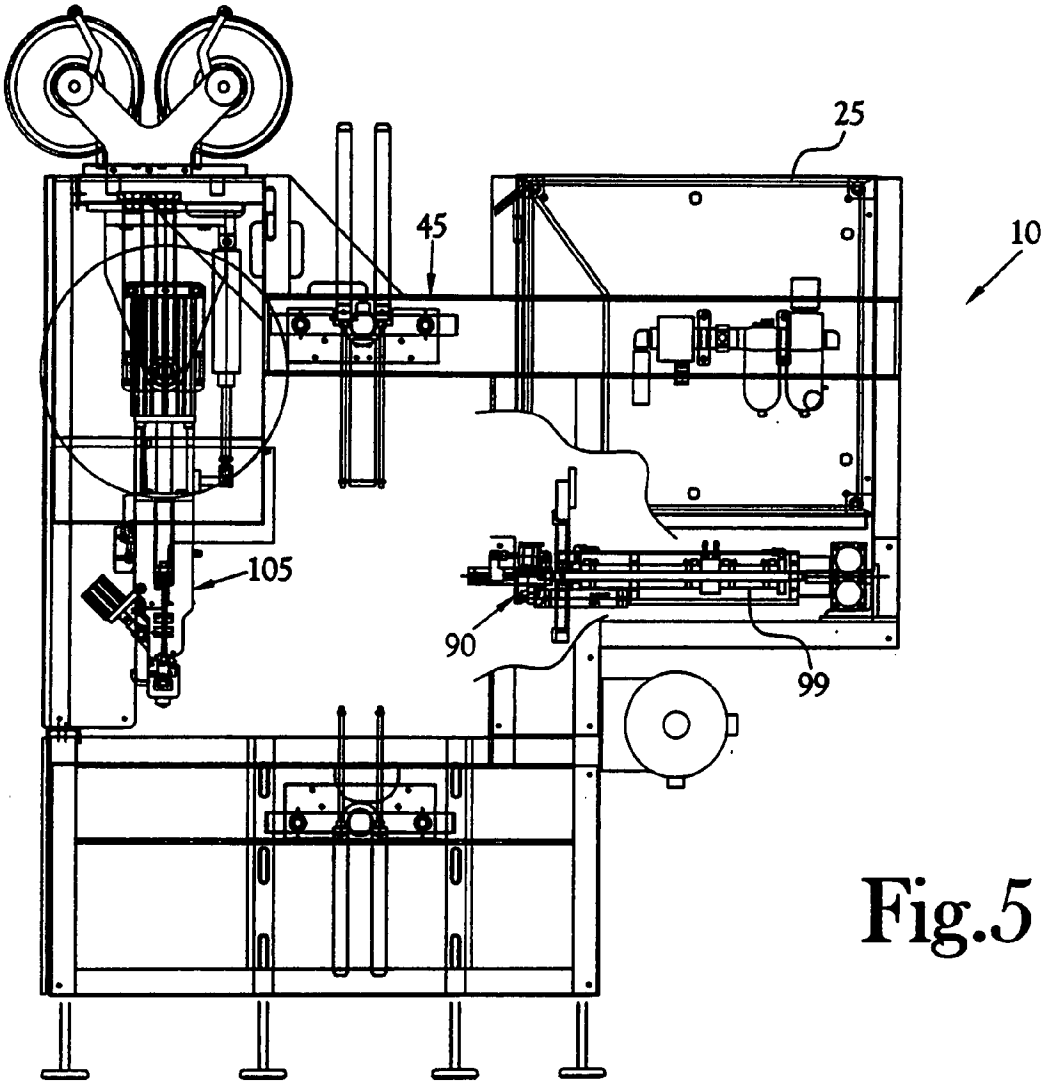
FIG. 5 is an elevation view, with certain elements removed for clarity of view, showing the clipper device in the rest position.
Figure 5A:
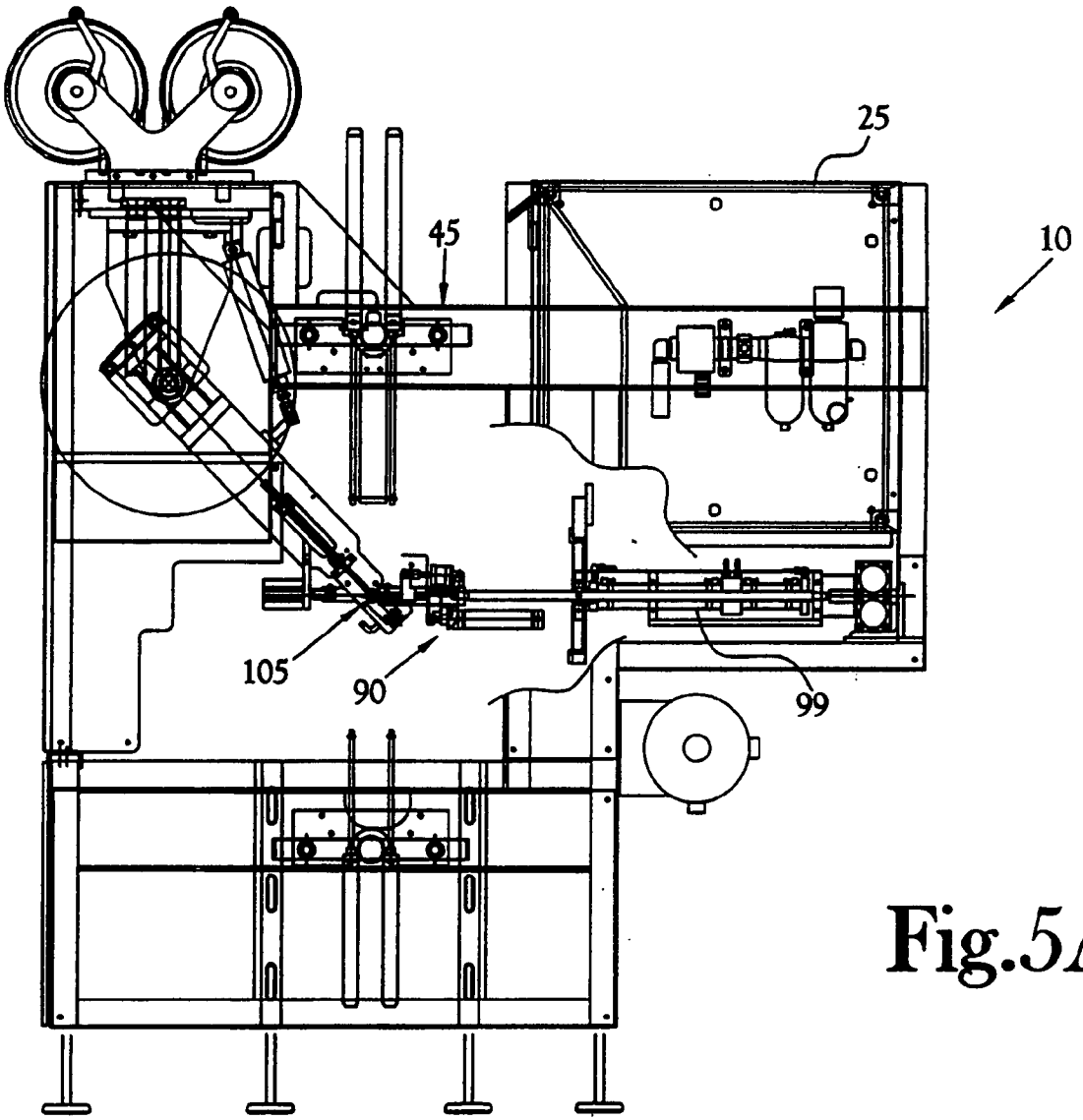
FIG. 5A is an elevation view, with certain elements removed for clarity of view, showing the clipper device in the rotated, or engaged, position.
Figures 6A, 6B, 6C, 6D, 6E:
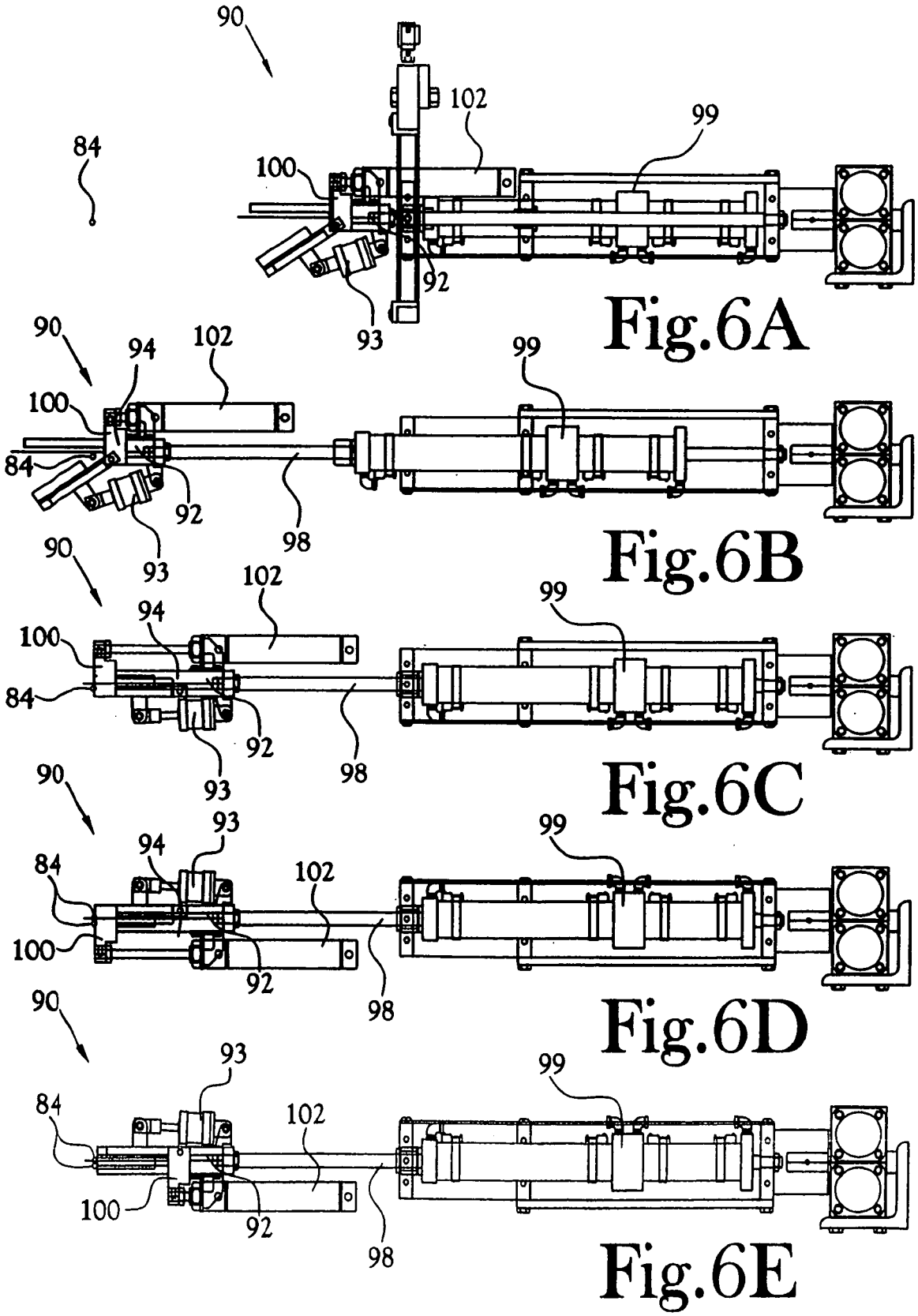
FIGS. 6A–6E are rear elevation views of the handle formation assembly showing the various stages of its actuation.
Figure 10:
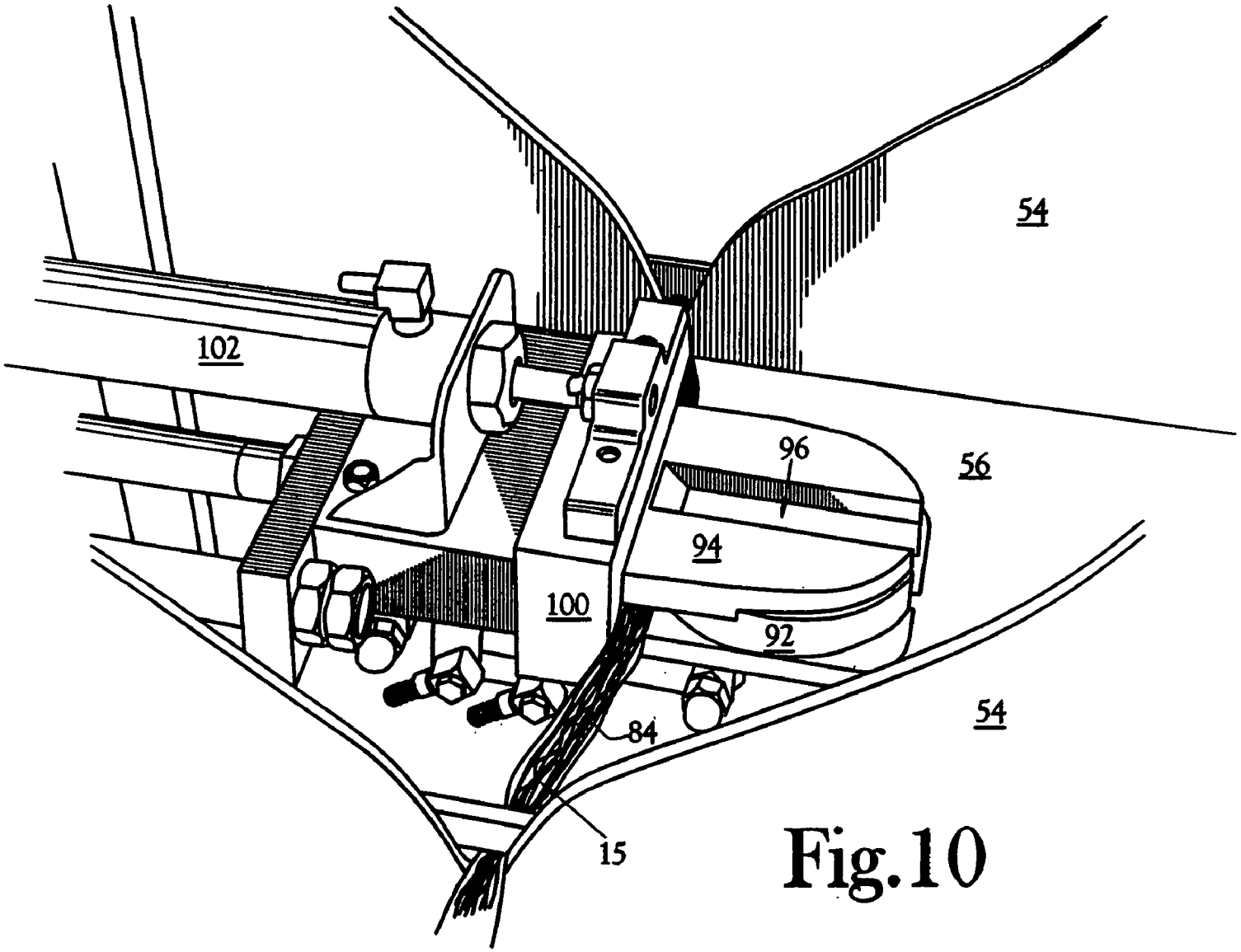
FIG. 10 is a partial front perspective view illustrating the handle formation assembly in the fully extended position, with the handle forming jaw cover retracted.
Figure 11:
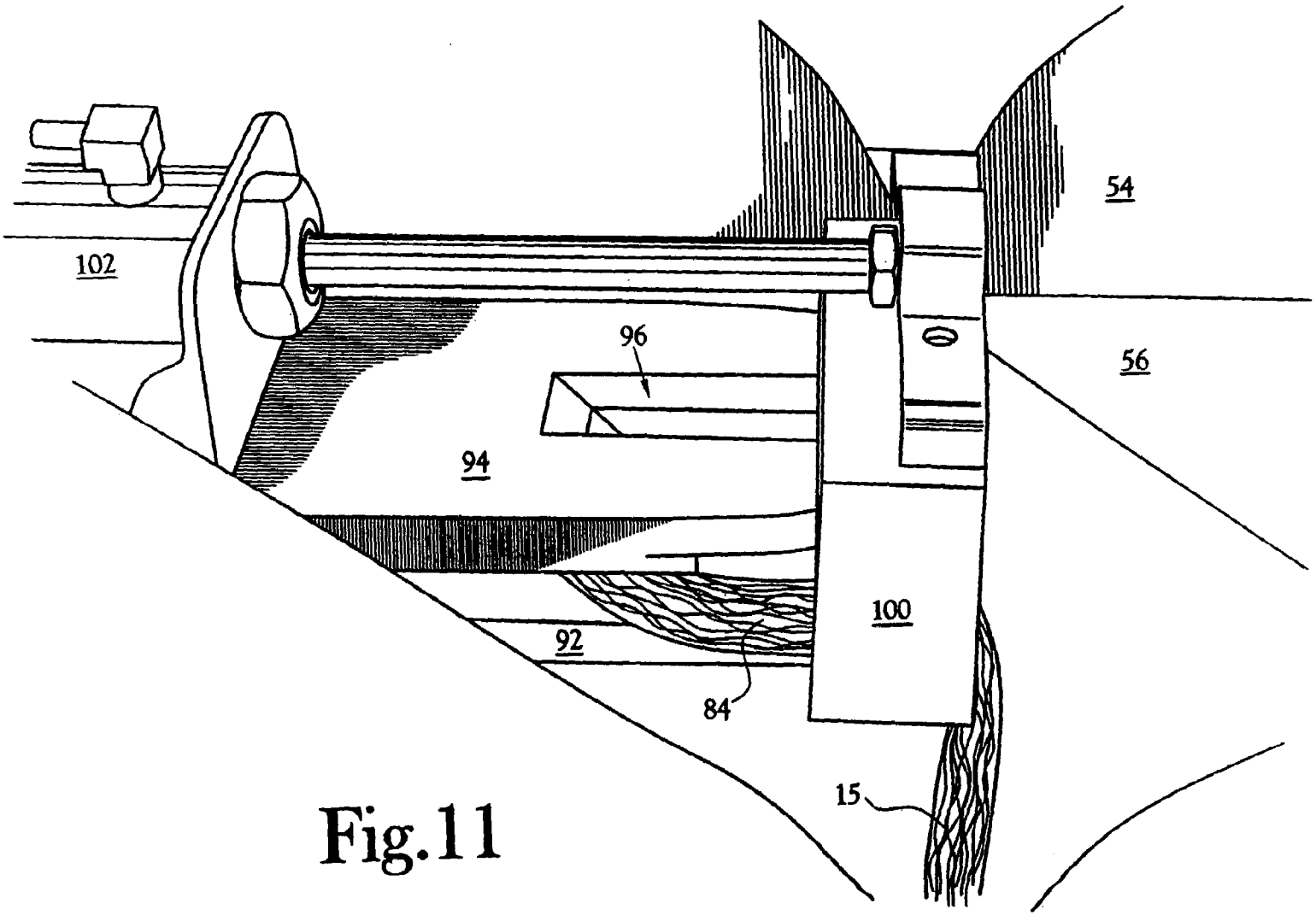
FIG. 11 is a partial front perspective view of the detail shown in FIG. 10 illustrating the handle formation assembly fully extended and the handle forming jaw member engaged with the mesh covering material and the jaw cover extended.
Figure 12:
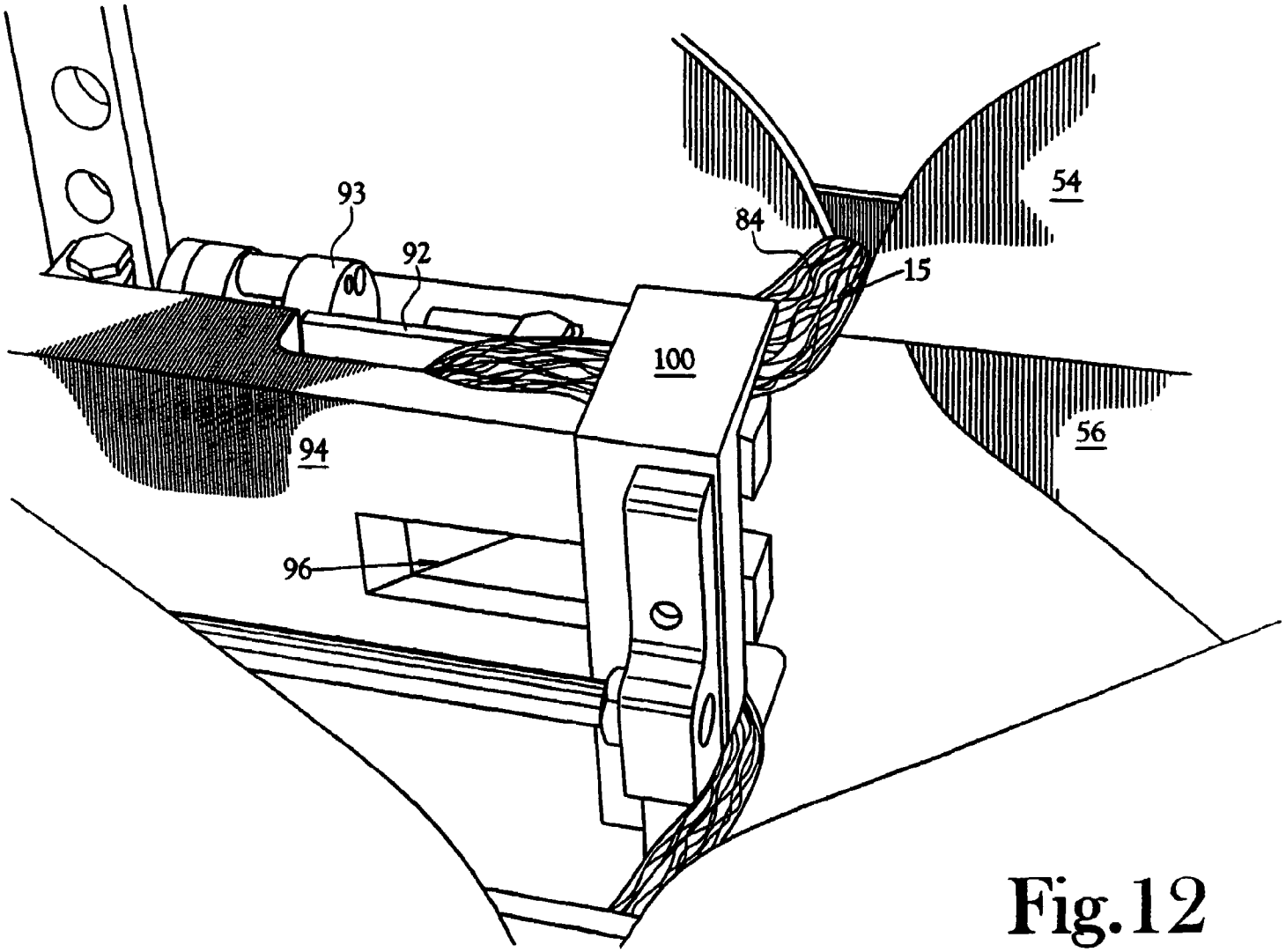
FIG. 12 is a partial front perspective view of the detail shown in FIG. 11 midway during the step of rotating the handle formation jaw.
Figure 13:
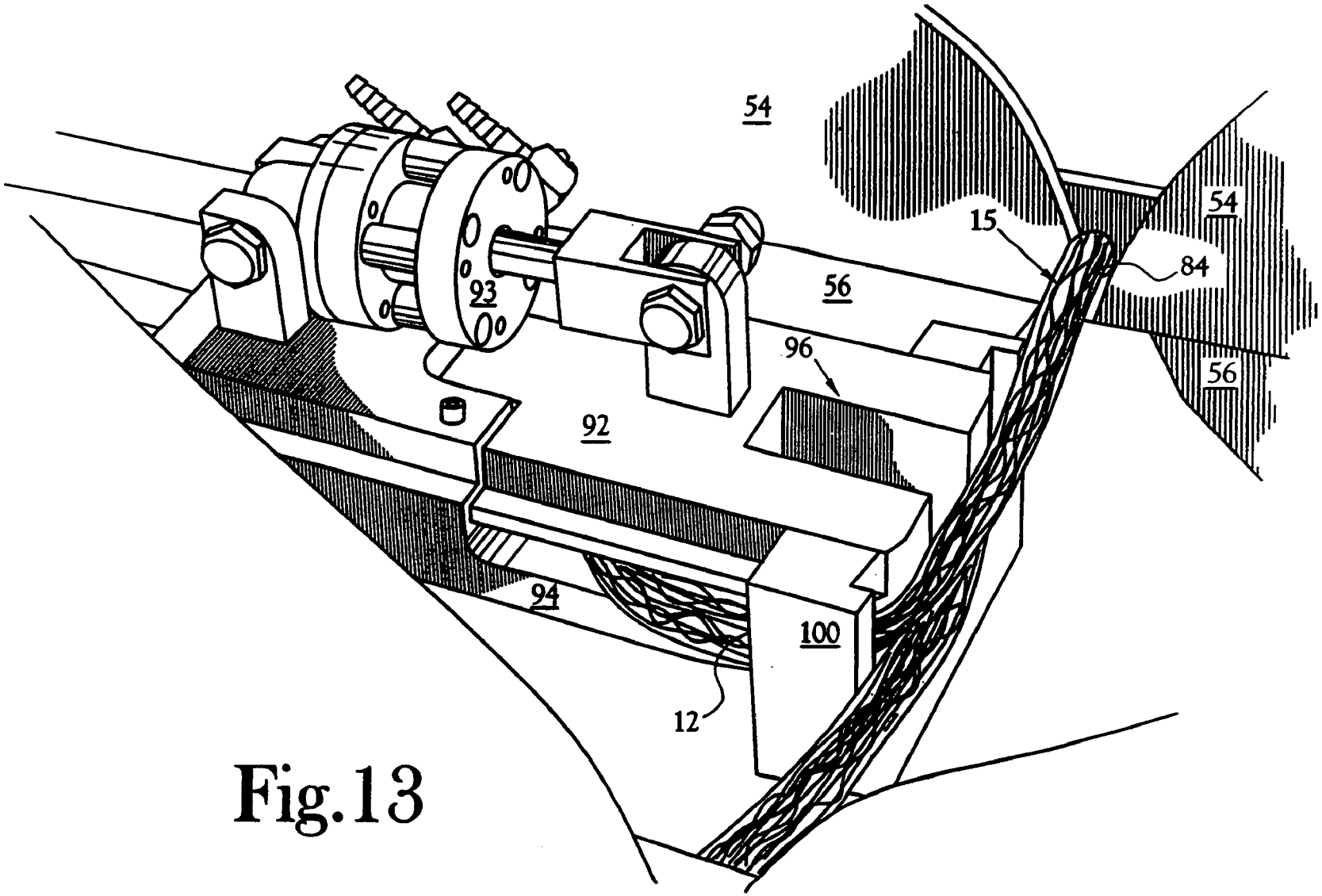
FIG. 13 is a partial front perspective view of the detail shown in FIG. 12 upon completion of the step of rotating the handle formation jaw.
Figure 14:
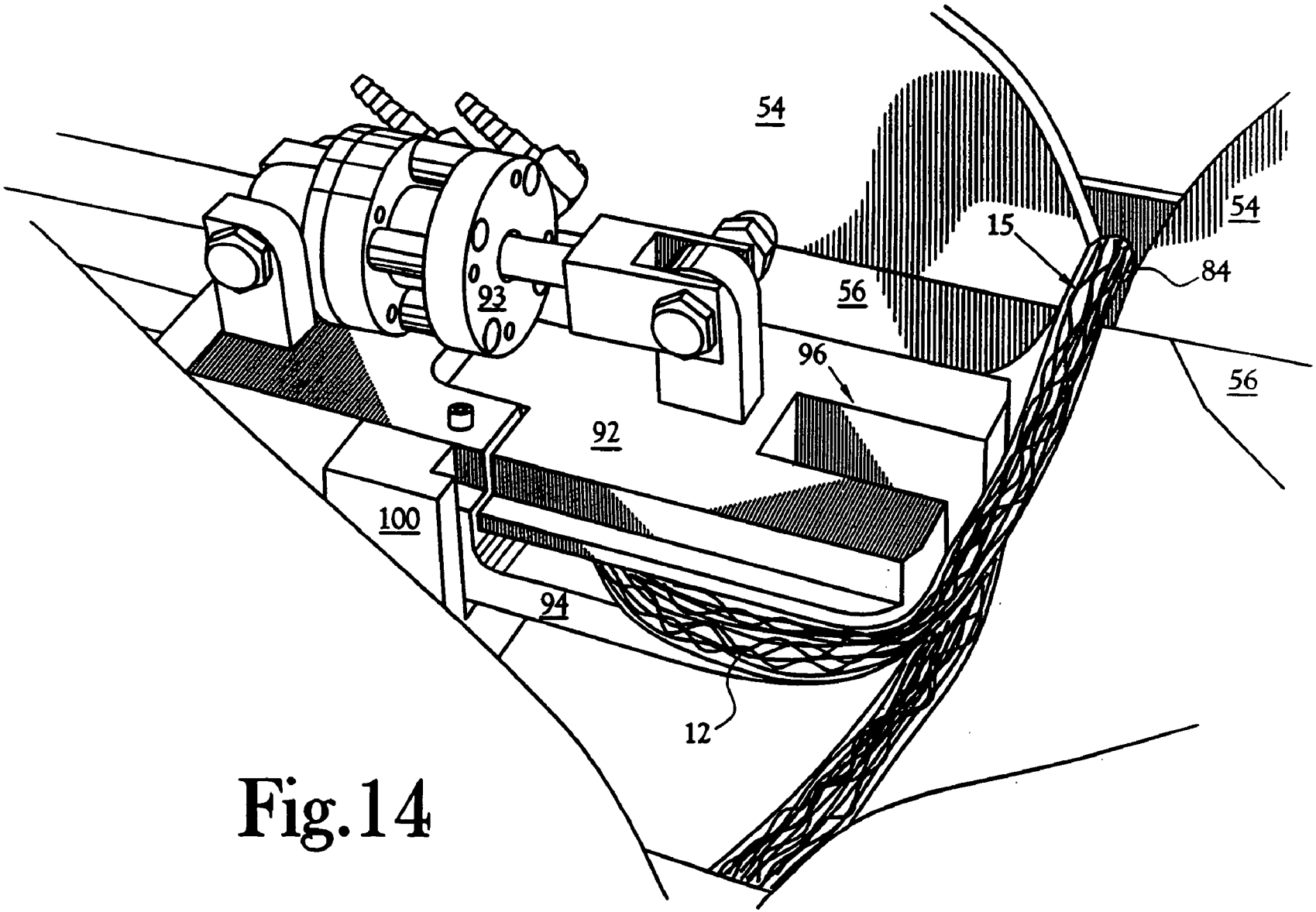
FIG. 14 is a partial front perspective view of the detail shown in FIG. 13 after the jaw cover has been retracted.
Figure 15:
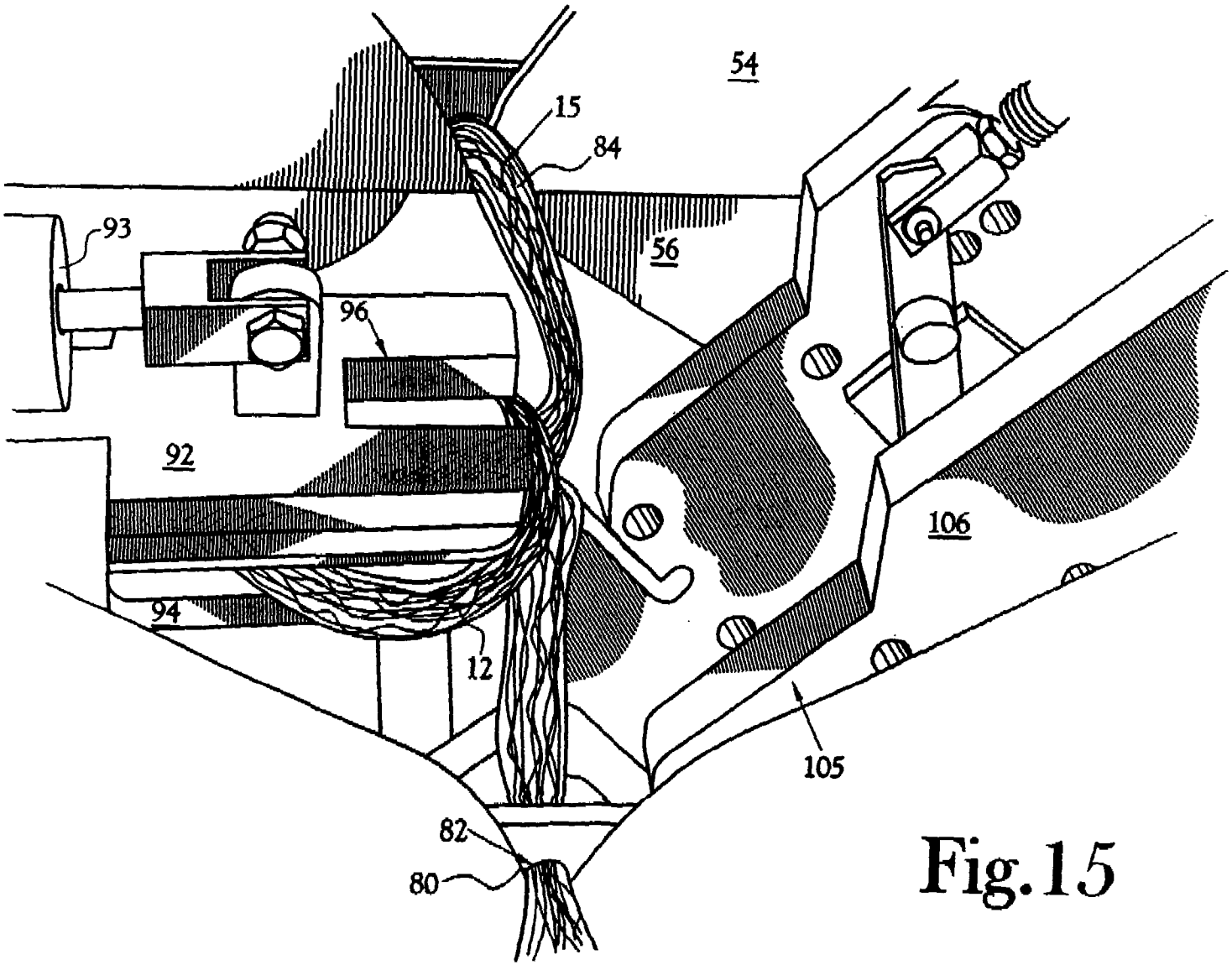
FIG. 15 is a partial front perspective view of the detail shown in FIG. 14 illustrating rotation of the clipper device towards the engaged, or clip, position.
Figure 16:
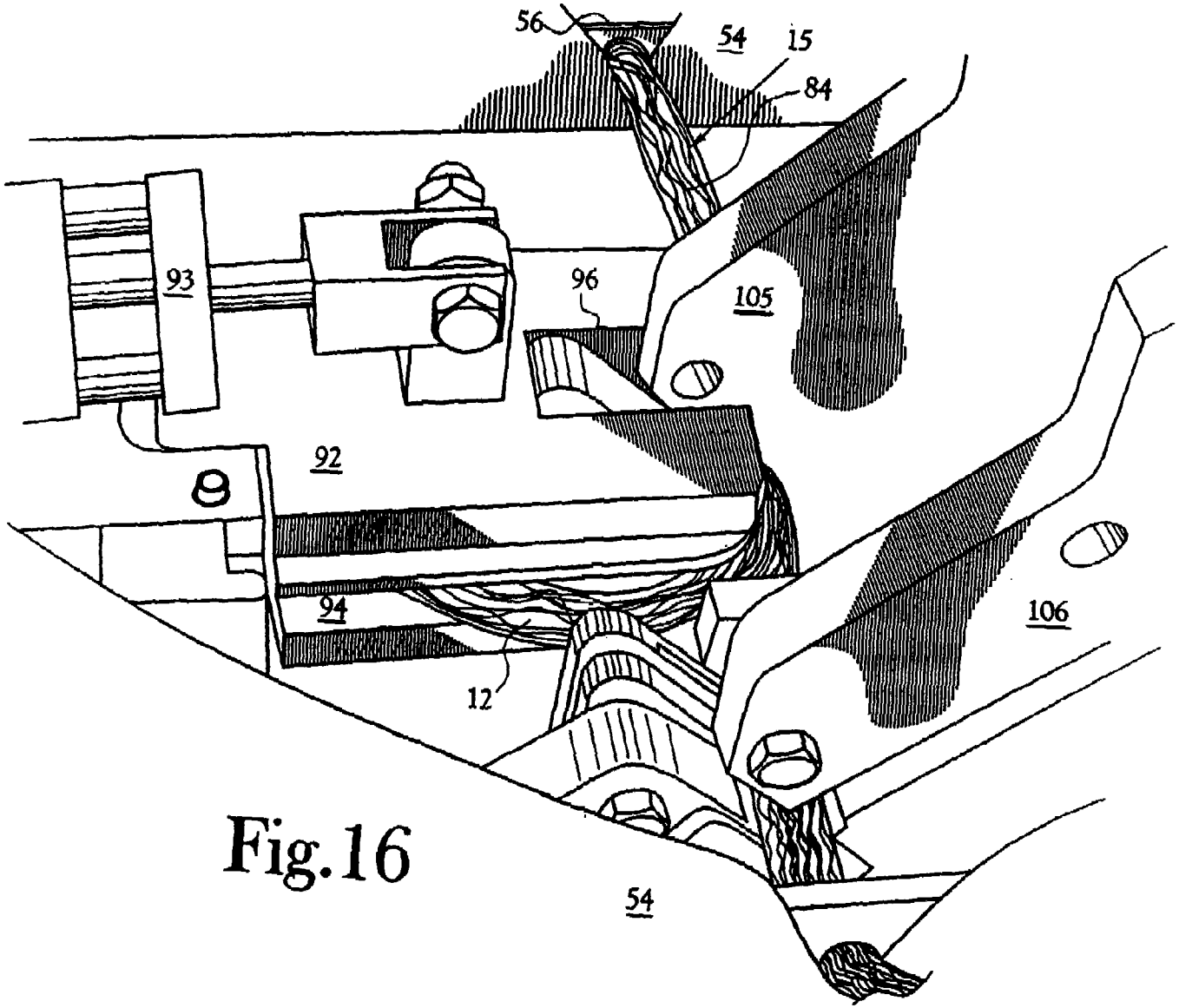
FIG. 16 is a partial front perspective view of the detail shown in FIG. 15 illustrating the clipper device in the engaged, or clip, position.

Further, the apparatus 10 includes a handle formation assembly 90 for engaging the compressed cord 84 of tubular covering and forming the compressed cord 84 into a loop handle 12. In this regard, a handle formation jaw 92, actuated by a jaw actuator 93, and a jaw plate 94, each having an elongated slot 96 opening outwardly therefrom, are carried by an elongated rod 98 actuated by a dual stage cylinder 99. The initial position of the handle formation assembly 90 is illustrated in FIGS. 5 and 6A. When engaged, the dual stage cylinder 99 is fully extended, as seen in FIG. 6B and FIG. 10, and the handle formation jaw 92 closes on the compressed cord 84. The second stage of the dual stage cylinder 99 is retracted, see FIG. 6C, and the handle jaw cover 100, which is actuated by cover actuator 102 is extended so as to force the compressed cord 84 against the, preferably arcuate, surface of the jaw thereby forming a partial loop, see also FIG. 11. The handle formation jaw 92 is rotated 180 degrees, see FIG. 6D, preferably by a rotary actuator 104, and the jaw cover is retracted, see FIG. 6E. As seen in FIGS. 5A, 15 and 16, the clipper device 105, which is carried by the frame of the apparatus 10 in spaced relation from the handle formation assembly, rotates into a position to engage, and be received by, the slot 96 disposed in the handle formation assembly 90, thus engaging the compressed cord 84 of tubular covering 15. The clipper device 105 secures two clips to the compressed cord 84, one to secure the bottom of the tubular covering for the food product 16 being covered, and one to secure the loop handle, (and tag if desired), for the tubular covering 15 in preparation of receiving a subsequent food product to be covered. Further a clipping knife severs the compressed cord 84 of tubular covering at a point disposed between the two securing clips. As described above, the product restraining assembly 65 is provided to capture and restrain the food product as it passes through the voider gate assembly, see FIG. 8A, position the covered food product for clipping, see FIG. 8B and to release the food product upon completion of the apparatus's handle formation and clipping cycle, see FIG. 8C. A flow diagram showing the steps of operation of the apparatus 10 is set forth in FIGS. 4, 4A, 4B and 4C.

Figure 17A:
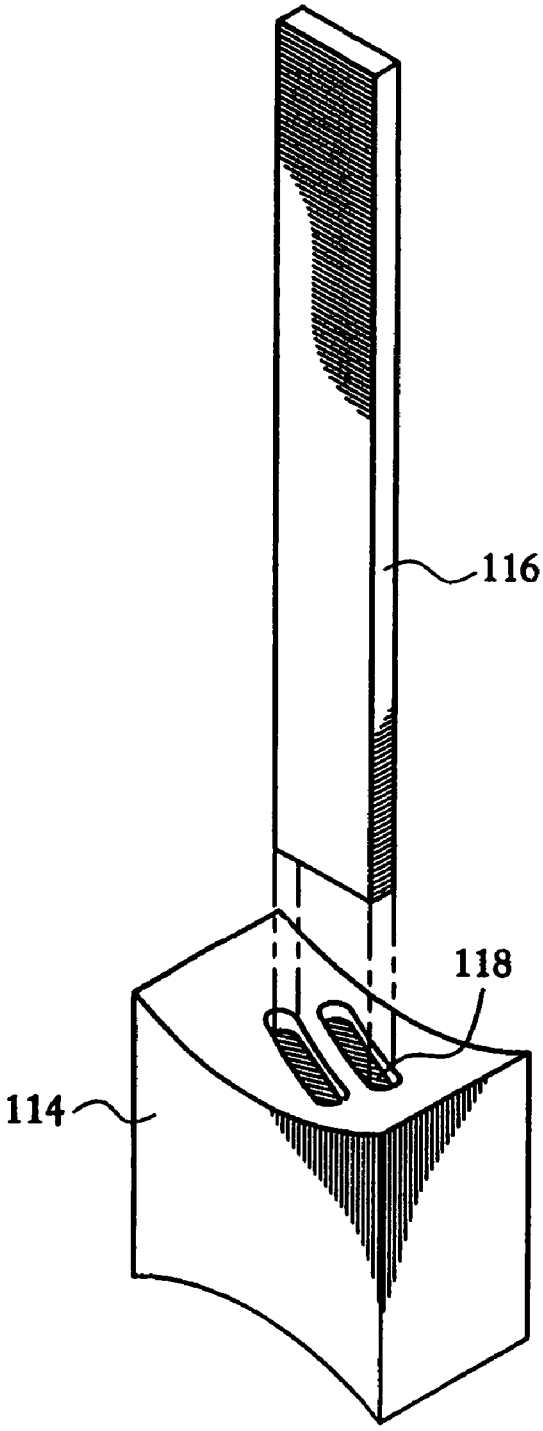
FIGS. 17A and 17B are perspective views of the clipping punches and clipping dies utilized by the clipper device of the present invention.
Figure 17B:
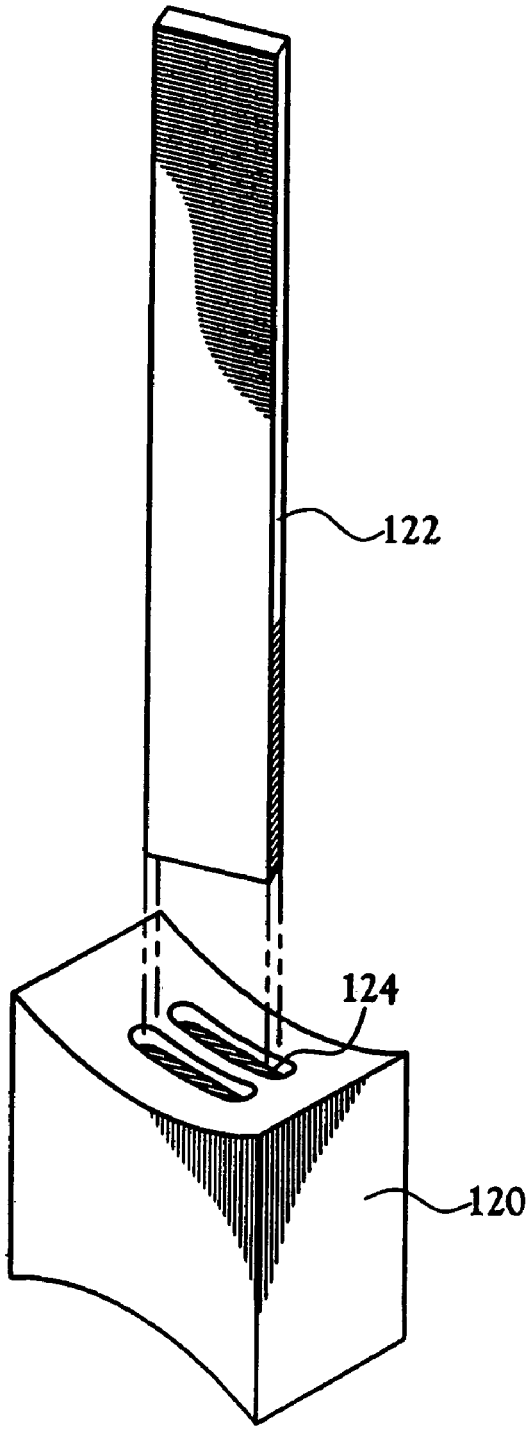
Figure 18:
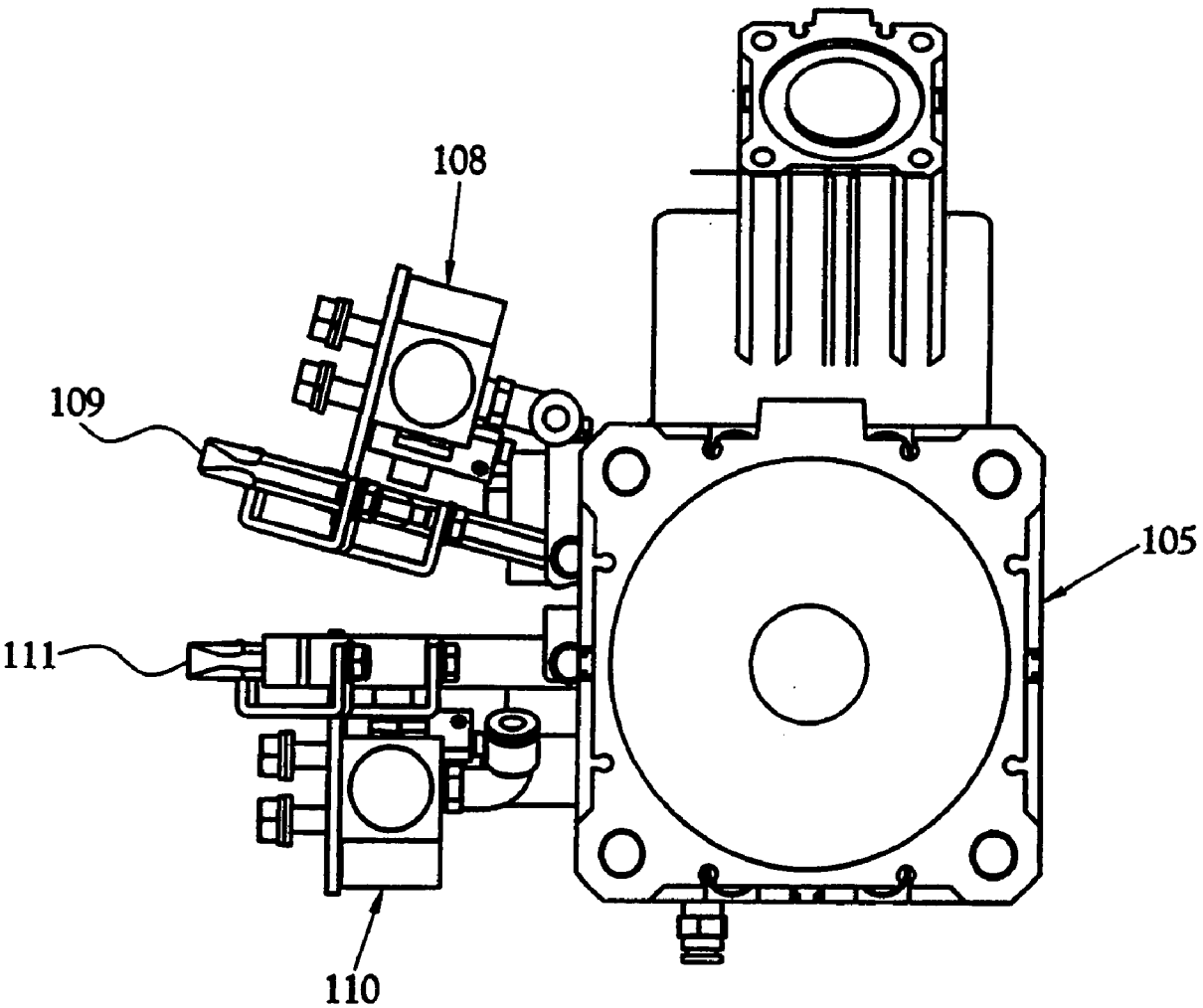
FIG. 18 is a top plan view of the clipper device showing the relative positioning of the clip rails on the same side of the clipper device.
Figure 19A:
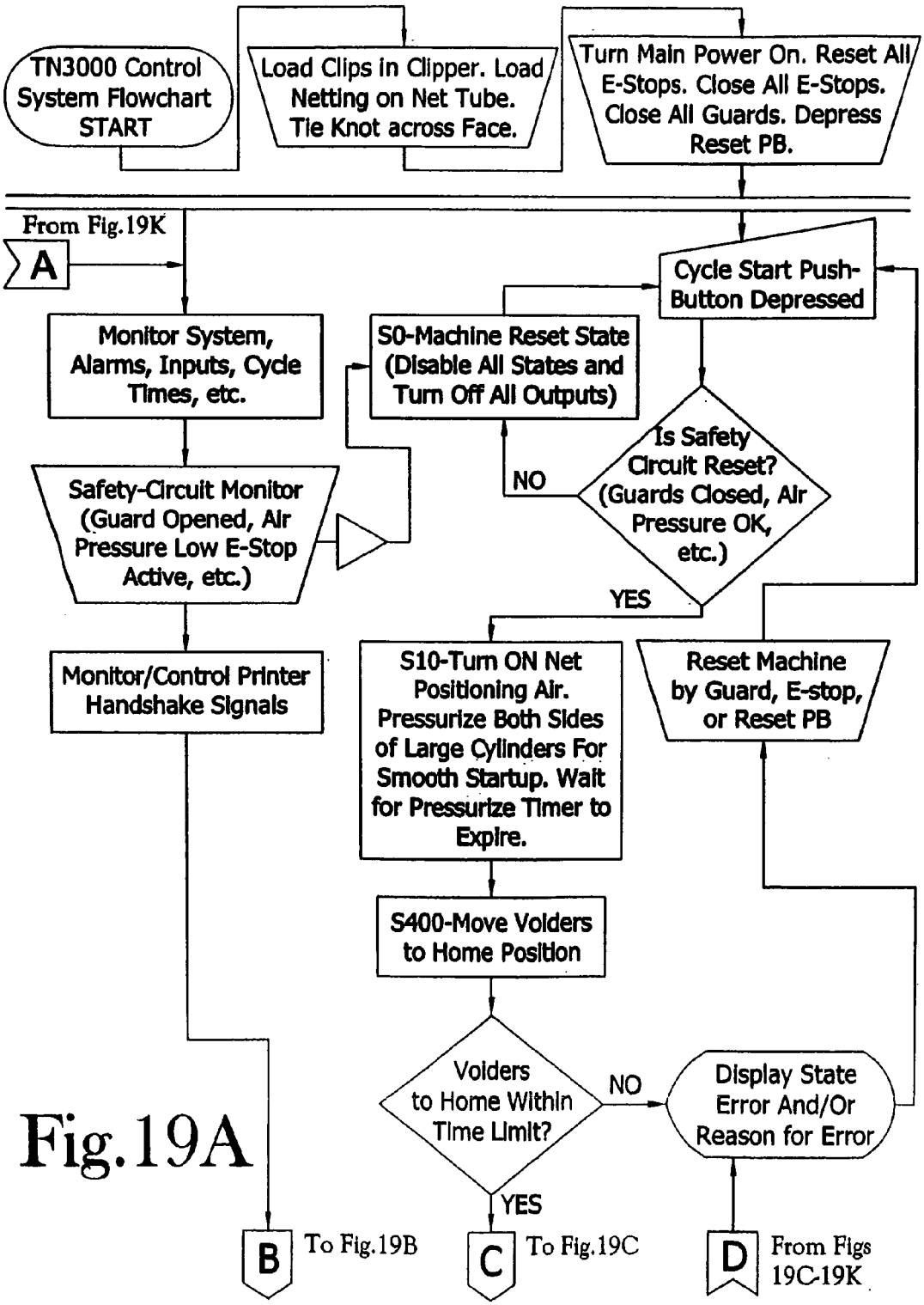
FIGS. 19A–19K is a flow chart showing the operational details of one embodiment of the present invention.
Figure 19B:
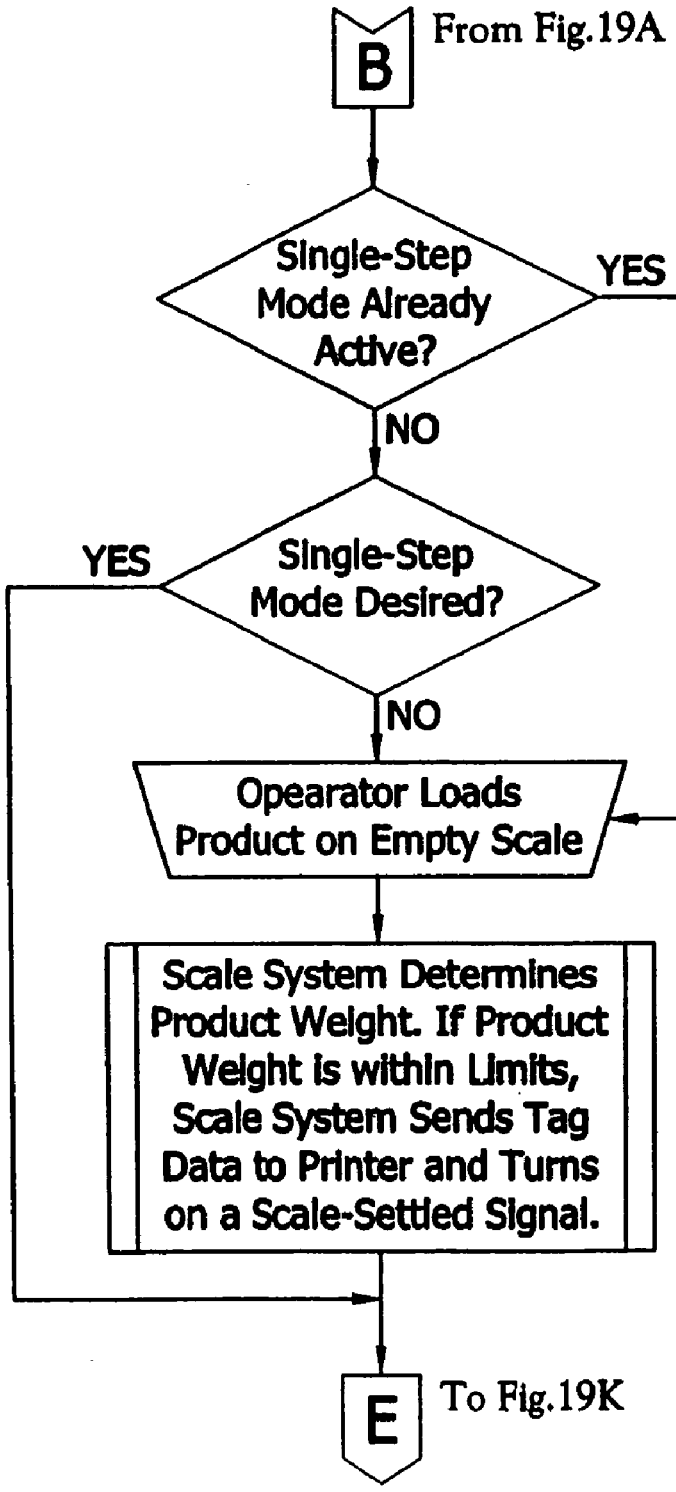
Figure 19C:
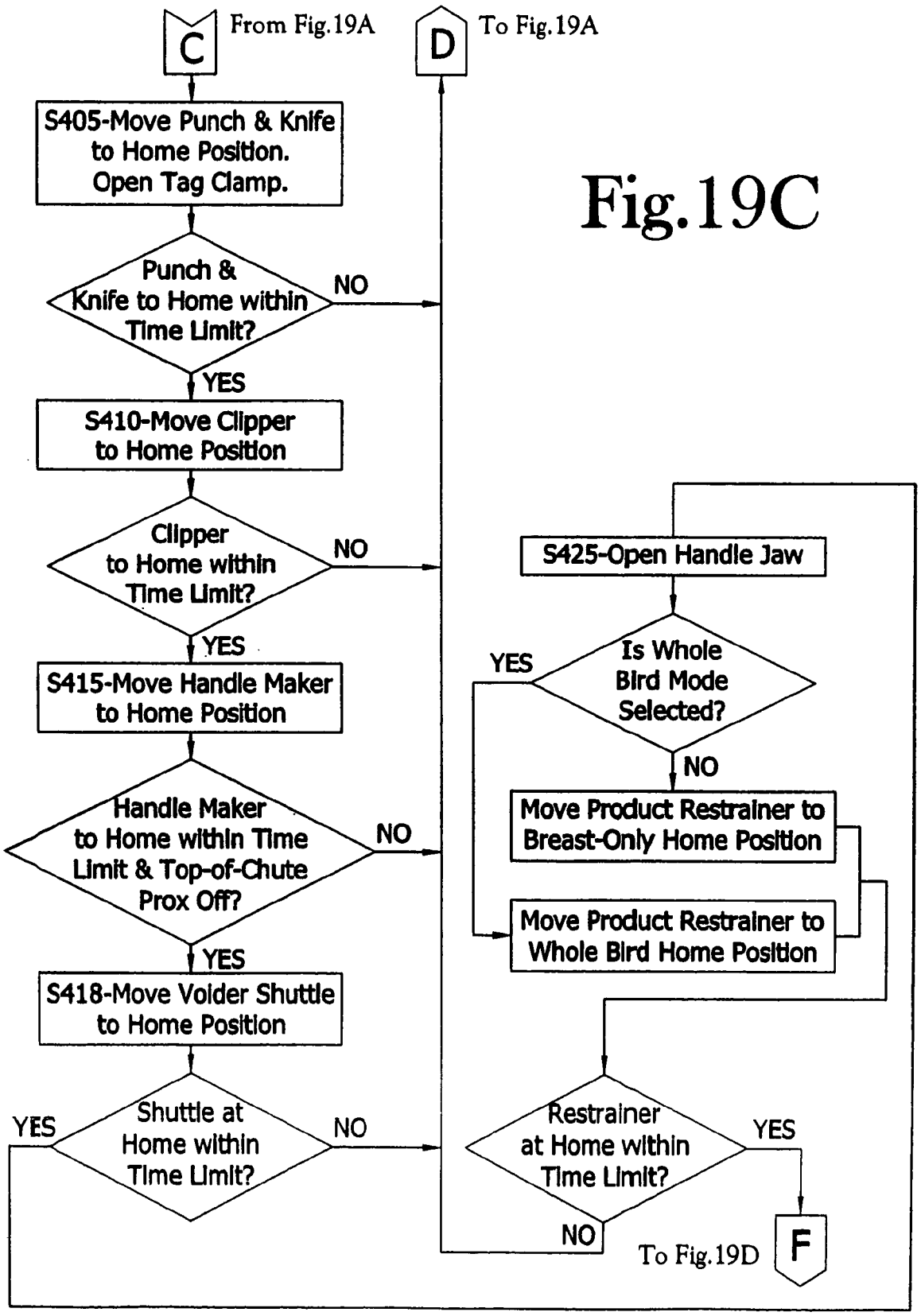
Figure 19D:
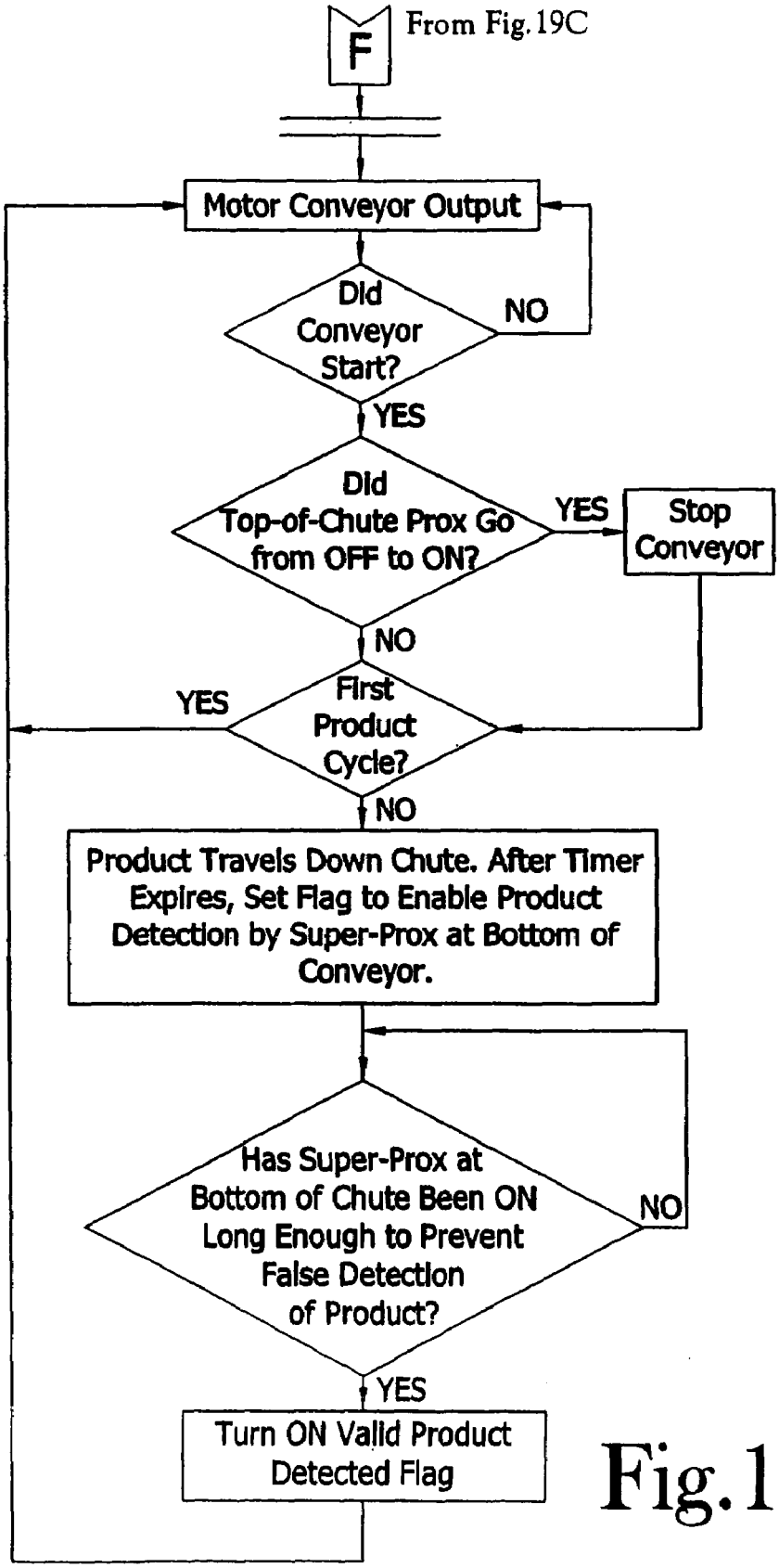
Figure 19E:
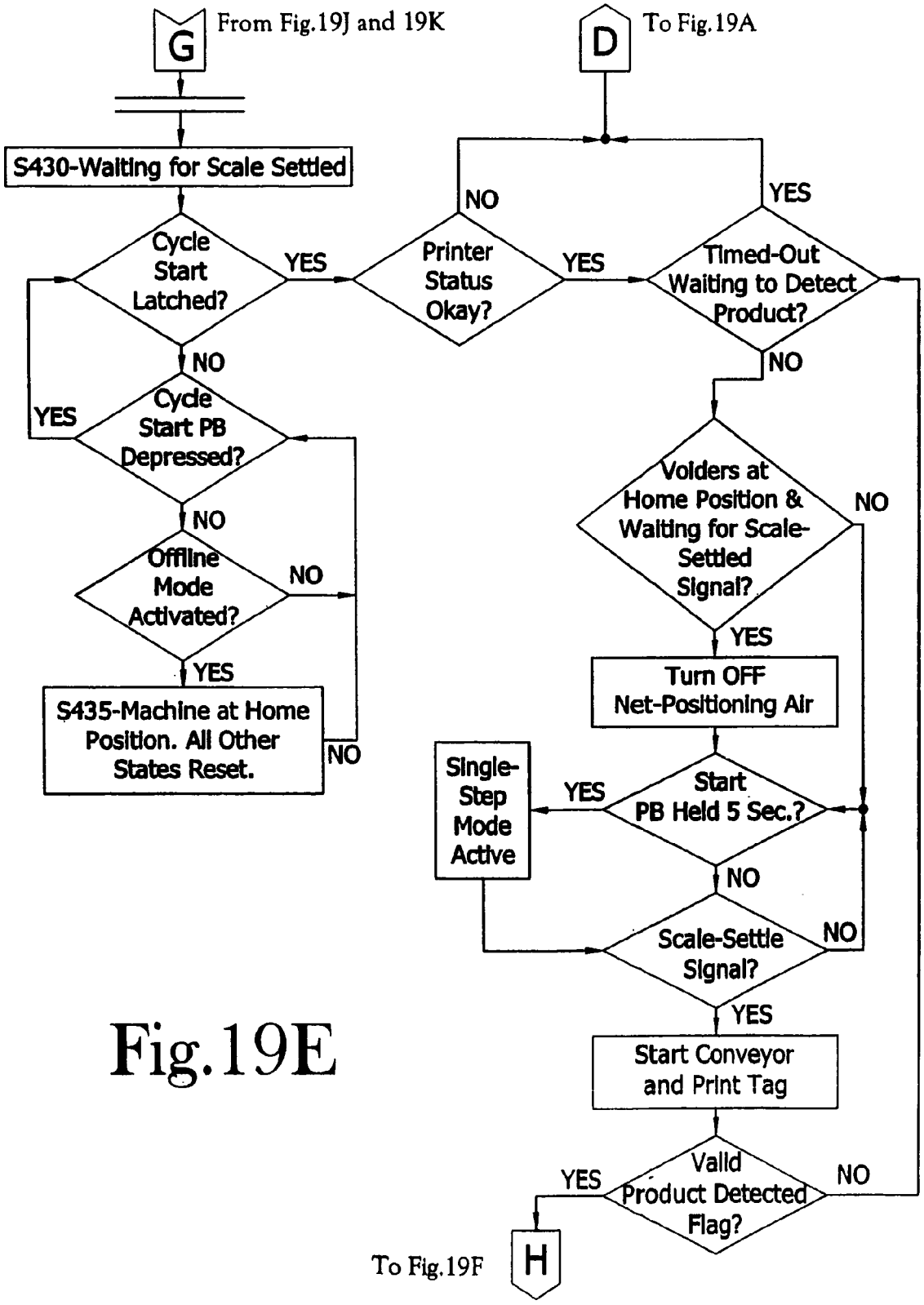
Figure 19F:
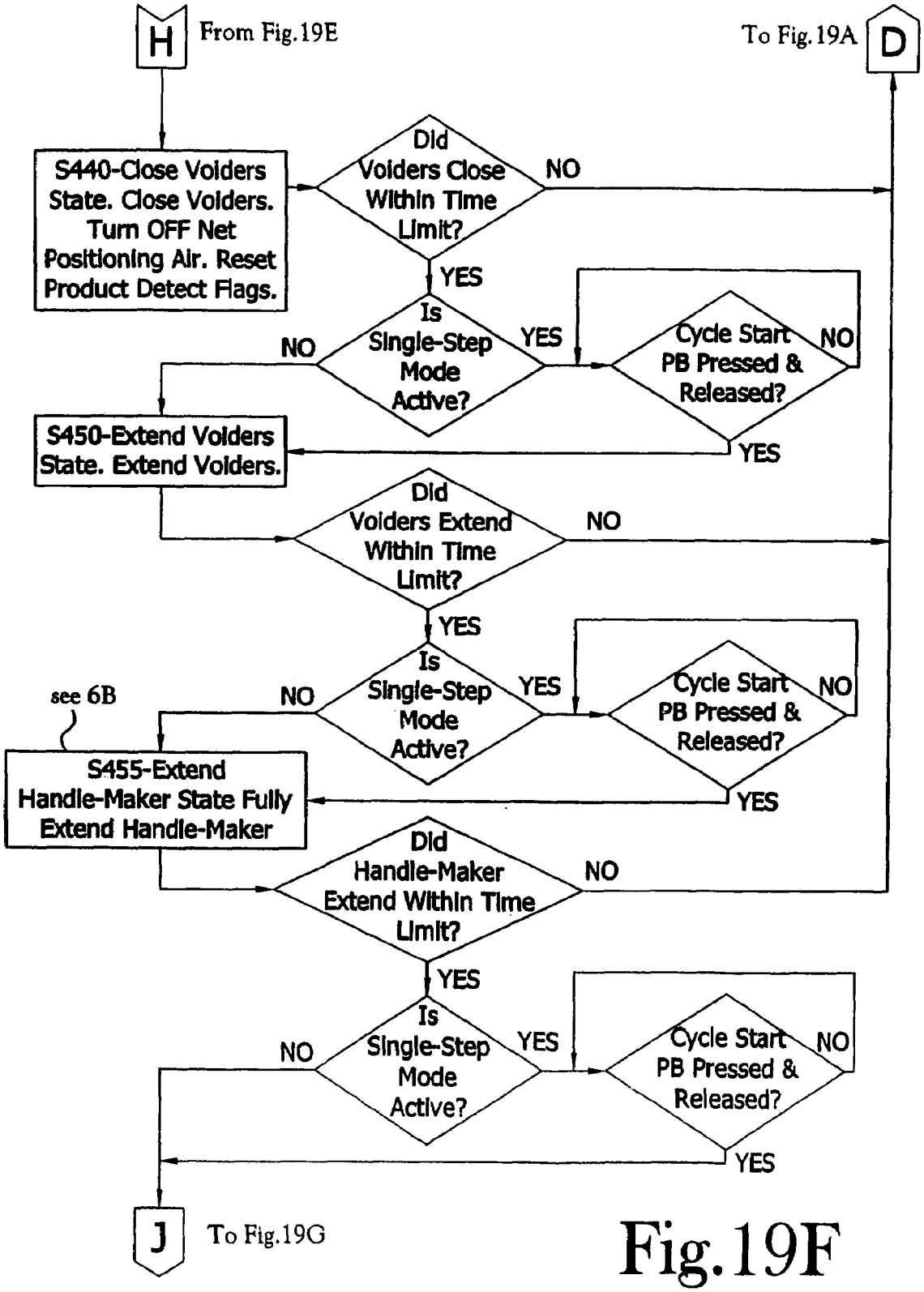
Figure 19G:
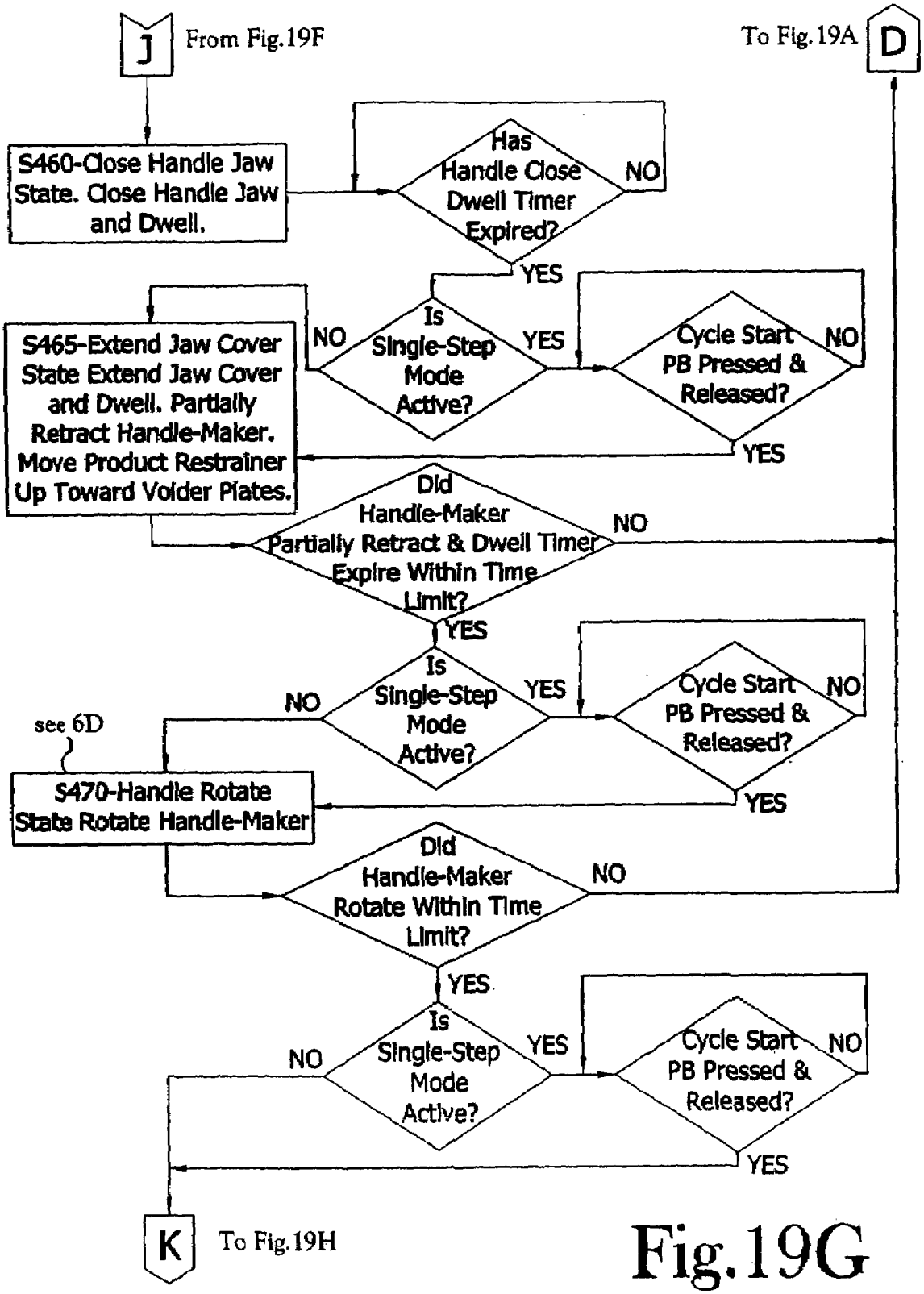
Figure 19H:
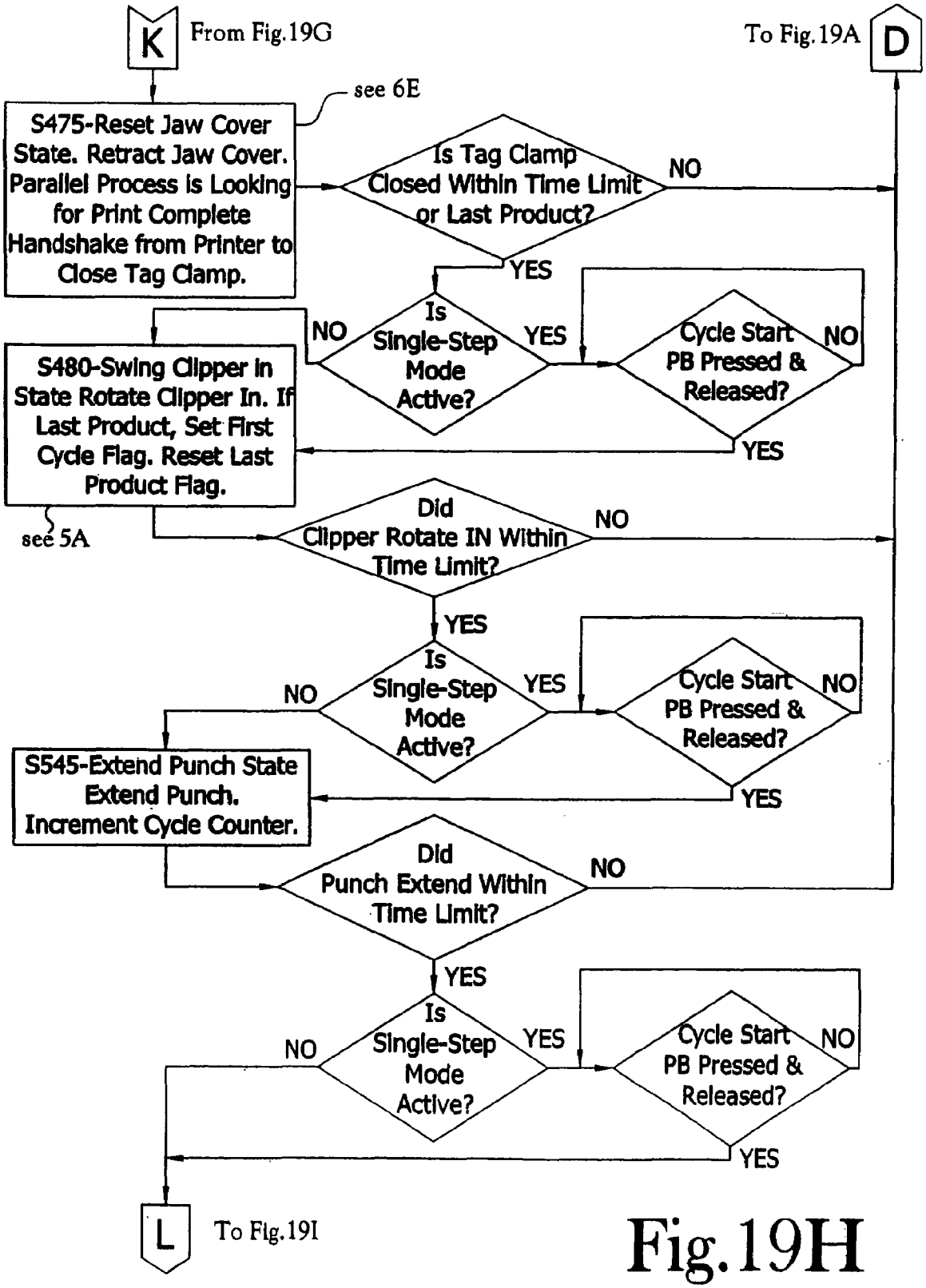
Figure 19I:
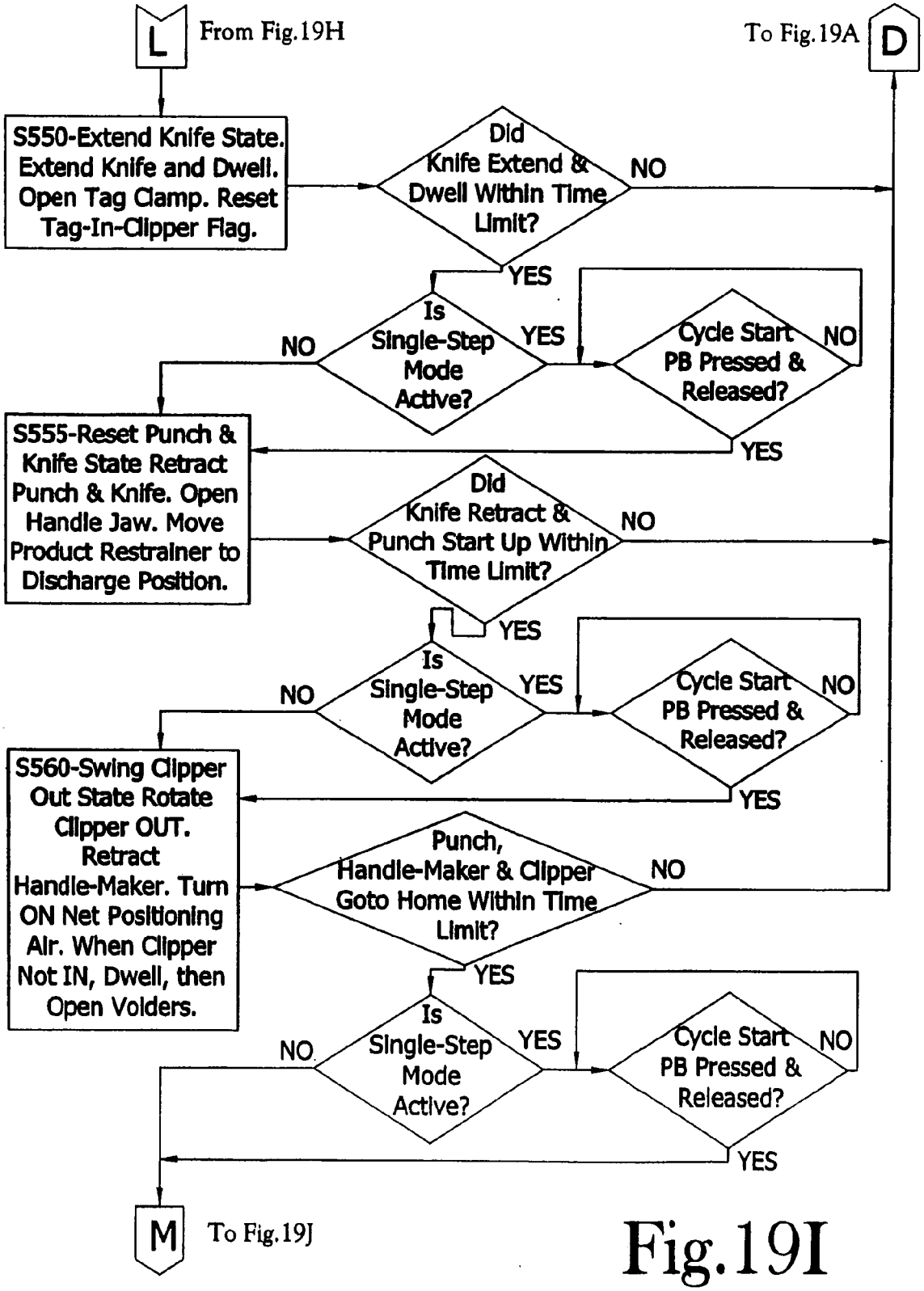
Figure 19J:
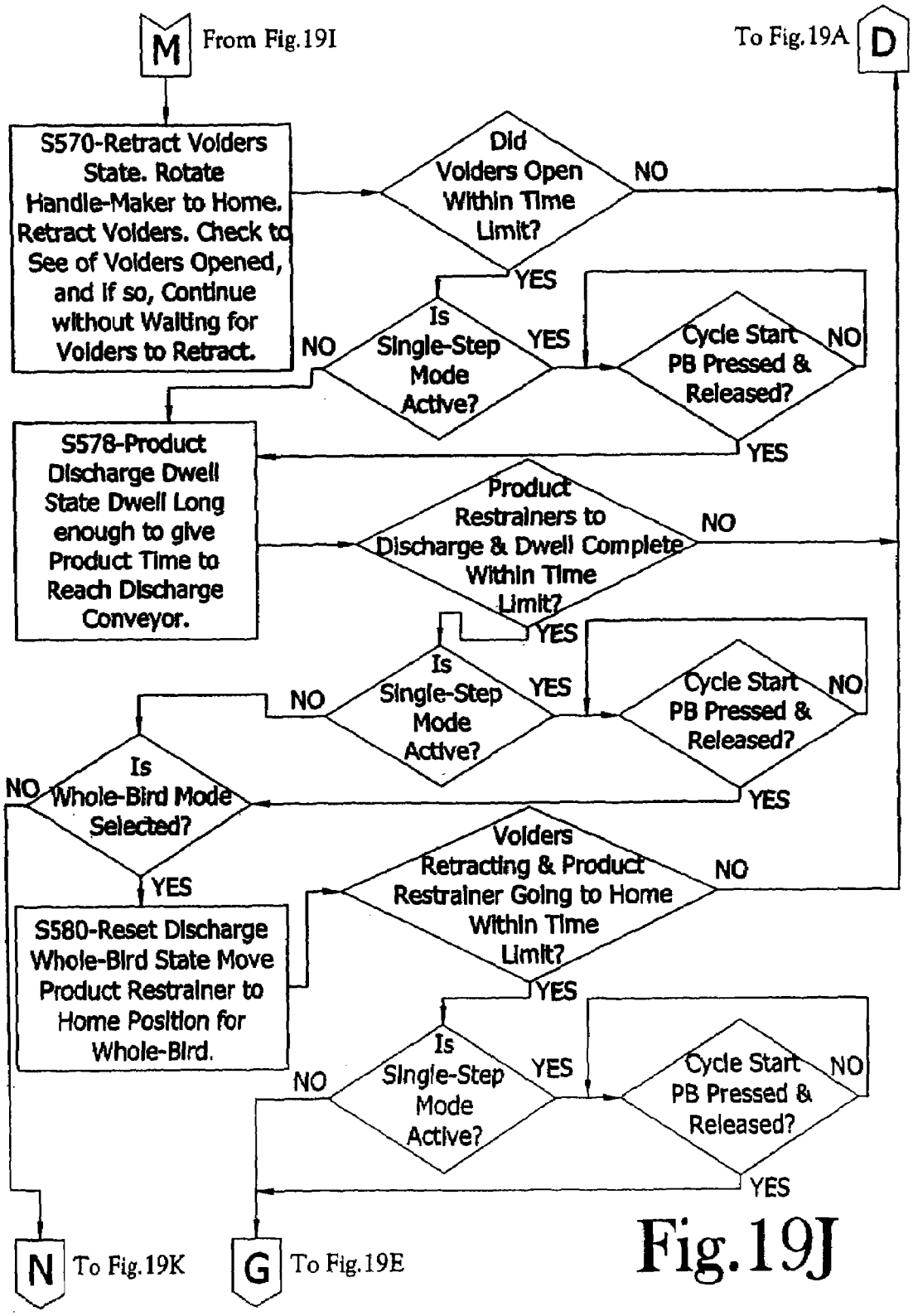
Figure 19K:
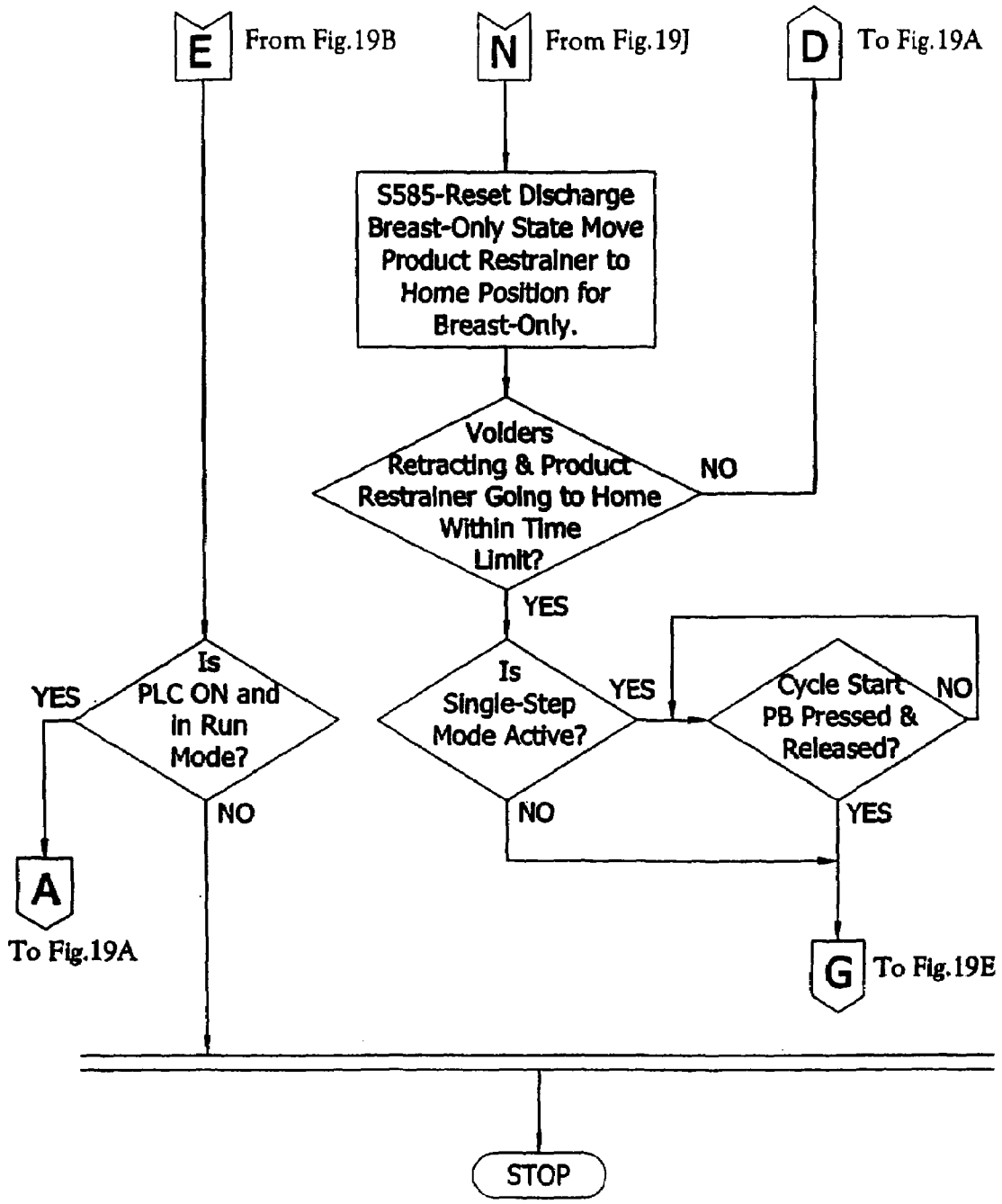

As seen in the drawings the clipping device 105 is configured with both clip rail assemblies 108 and 110 disposed on the same side of the clipping device 105, a novel arrangement contrary to a conventional clipping device having a clip rail assembly disposed on each side of the clipping device. Placement of both clip rail assemblies 108 and 110 on one side of the clipping device, i.e. opposite the side 106 which cuts the compressed cord 84 of the tubular covering 15, allows for extremely close tolerances between the cutting side 106 of the clipping device 105 and the movable set of voider gates 50, therefore a desirable tight package can be obtained. Except for the novel placement of clip rail assemblies 108 and 110, the clip rail assemblies are conventional clip rail assemblies as will be readily understood by those skilled in the art. In order to accommodate this novel arrangement, the clip rail assembly 108 that supplies clips to the opposite side of the clipping device 105 is angled as best illustrated in FIG. 18. As is known in the art, the clips are punched in a manner that causes the legs of the clips to be substantially parallel to one another. As can be seen in FIG. 17A, the first clip die 114 which is formed in a conventional manner, in which the punch 116 and the die 114 lie in substantially the same plane as the side of the clipping device while the grooves 118 formed in the clip die are at a selected angle relative to the plane of the side of the clipping device, this angling of the grooves 118 in the clip die 114 allows the desired bending of the clip legs. However, in order to accommodate the clips that are fed into the opposite side of the clipping device 105, and at an angle relative to the side 106 of the clipping device 105, the punch 122 is angled as can be clearly seen in FIG. 17B. Accordingly, as can be seen in FIG. 17B, the second clip die 120 is formed in a novel manner in which the grooves 124 formed in the die are in substantially parallel to the side of the clipping device.

From the foregoing description, it will be recognized by those skilled in the art that a device for defining a loop handle in a tubular covering for a food product, offering advantages over the prior art has been provided. In this regard, the handle forming device automates a process that has heretofore been accomplished by hand labor.

While the present invention has been illustrated by description of several embodiments and while the illustrative embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus, and illustrative examples shown and described. Accordingly, departures may be made from such details without departing from the spirit or scope of applicants' general inventive concept.

What is claimed is:

1. An apparatus for forming and securing a loop handle in a tubular covering for an item to be packaged, and for use with a conveyor assembly for conveying the item to be packaged from a first selected position to an upper end of a hereinafter identified chute, said apparatus comprising:

a frame for supporting said apparatus and for engaging a support surface;

a chute carried by said frame, wherein said chute is adapted for receiving the tubular covering and maintaining an end of said tubular covering in an open position whereby the item to be packaged engages the tubular covering at a distal end of said chute, and wherein the chute includes ridges disposed along the length of the chute for substantially preventing rotation of the item to be packaged;

a voider assembly carried by said frame proximate said chute, said voider assembly including a pair of voider gates defined by a stationary set of voider gates and a movable set of voider gates, wherein each set of voider gates is defined by voider plates, the voider plates of each gates having an opening that is adapted to be positioned so as to substantially register with said chute when said voider plates are in an open position, wherein said stationary voider gate is positioned proximate said distal end of the chute, and said movable voider gate is selectively movable between an extended position so as to be in spaced relation from said stationary voider gate and a retracted position so as to be positioned proximate said stationary voider gate, further wherein said stationary and said movable voider gates are adapted to gather said tubular covering when said voider plates are in a closed position thereby forming an elongated gathered cord;

a product restrainer assembly carried by said frame, for receiving the item to be packaged as the item to be packaged exits said chute and passes through said voider assembly;

a handle formation assembly carried by said frame for engaging a portion of said gathered cord of tubular covering disposed between said stationary voider gate and said movable voider gate and forming said gathered cord into a loop handle;

clipper mechanisms carried by said frame in spaced relation from said handle formation assembly, for engaging said loop handle defined in said gathered cord of tubular covering and for securing at least a first clip and a second clip to said gathered cord for securing an open end of said tubular covering for the item to be packaged, and for securing said loop handle, wherein said clipper mechanisms are further adapted for severing said gathered cord of tubular covering at a point disposed between said first and second clips, and a scale for weighing the item to be packaged.

2. The apparatus of claim 1 wherein said item to be packaged is a food product.

3. The apparatus of claim 2 wherein said item to be packaged is a poultry product.

4. The apparatus of claim 1 wherein said apparatus further comprises a conveyor belt for conveying the item to be packaged towards said chute.

5. The apparatus of claim 4 wherein said apparatus intersects a production line and said conveyor belt conveys the item to be packaged from the production line to said chute.

6. The apparatus of claim 1 wherein said chute is inclined so as to have an upper end proximate said conveyor assembly and further wherein said distal end defines a lower end, whereby the item to be packaged will travel through said chute under the force of gravity.

7. The apparatus of claim 1 wherein said product restrainer assembly includes a slide plate, and the product restrainer assembly catches the item to be packaged as said item to be packaged exits said chute and allows discharge of item to be packaged.

8. The apparatus of claim 1 wherein said openings in the top and bottom voider plates include bites that cooperate, and register, when said voider plates are in a closed position, to form a narrow channel whereby said tubular covering is gathered into said gathered cord.

9. The apparatus of claim 1 wherein said handle forming assembly includes a handle formation jaw, actuated by a jaw actuator, said handle formation jaw being carried by an elongated rod actuated by a cylinder, said handle forming assembly further including a rotary actuator for rotating said handle formation jaw through a range of approximately one hundred and eighty degrees.

10. The apparatus of claim 1 wherein said clipper mechanisms are configured with first and second clip rail assemblies.

11. The apparatus of claim 1 further comprising a tag dispenser for dispensing a tag containing information about the item to be packaged.

* * * * *